US007121217B2

(12) United States Patent
Mizuno et al.

(10) Patent No.: US 7,121,217 B2
(45) Date of Patent: Oct. 17, 2006

(54) SEWING MACHINE WITH AUTOMATIC THREADER

(75) Inventors: Noboru Mizuno, Nagoya (JP); Yoshihisa Shoji, Okazaki (JP); Shinya Fujihara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/154,821

(22) Filed: Jun. 17, 2005

(65) Prior Publication Data

US 2006/0005752 A1 Jan. 12, 2006

(30) Foreign Application Priority Data

Jun. 17, 2004 (JP) ..... 2004-179606

(51) Int. Cl.
*D05B 87/02* (2006.01)

(52) U.S. Cl. ..... 112/225

(58) Field of Classification Search ..... 112/225, 112/224, 226, 227, 237, 238, 239
See application file for complete search history.

(56) References Cited

U.S. PATENT DOCUMENTS 4,651,660 A 3/1987 Oshima et al.
5,092,257 A * 3/1992 Ogawa ..... 112/225
6,564,731 B1 * 5/2003 Sano et al. ..... 112/225
6,701,858 B1 * 3/2004 Wacker ..... 112/225
6,776,113 B1 8/2004 Sakakibara et al.
6,779,470 B1 8/2004 Sakakibara et al.
6,814,016 B1 * 11/2004 Hori ..... 112/225
6,880,473 B1 * 4/2005 Fukao ..... 112/225
6,959,656 B1 * 11/2005 Fukao ..... 112/225
6,981,459 B1 * 1/2006 Kitazawa et al. ..... 112/225
2004/0086210 A1 5/2004 Janz
2004/0089211 A1 5/2004 Hori

FOREIGN PATENT DOCUMENTS

JP A-2004-024729 1/2004
JP A-2004-041355 2/2004

* cited by examiner

*Primary Examiner*—Danny Worrell
(74) *Attorney, Agent, or Firm*—Oliff & Berridge, PLC

(57) ABSTRACT

A sewing machine includes a thread transferring mechanism automatically hooking onto thread hooking sections a needle thread which extends from a thread supply and which is retained in a predetermined thread preparatory path while retaining the needle thread so that the needle thread can be turned over to a needle threading mechanism, and a control unit which controls a thread tension adjusting unit so that tension applied to the needle thread becomes a predetermined tension that correlates with a transfer position of the needle thread transferred by the thread transferring mechanism.

12 Claims, 33 Drawing Sheets

DRIVE AMOUNT TABLE

| DRIVE PULSE COUNT OF SECOND STEPPING MOTOR | DRIVE PULSE COUNT OF THREAD TENSION STEPPING MOTOR |
|---|---|
| P0 | NP0 (TENSION WHEN OPEN: NEARLY ZERO) |
| P1 | NP1 (TENSION WHEN CLOSED: 10 gf) |
| P2 | NP0 (TENSION WHEN OPEN: NEARLY ZERO) |

FIG.17

SEWING MACHINE WITH AUTOMATIC THREADER

BACKGROUND OF THE INVENTION

1. Field of the Invention

The present invention relates to a sewing machine having an automatic threader that transfers a needle thread drawn from a thread supply by a thread transferring mechanism to pass the needle thread through a plurality of thread passing sections.

2. Description of the Related Art

In a conventional sewing machine, a needle thread drawn from a thread spool is passed in a predetermined sequence and path and finally transferred to a sewing needle attached to a needle bar. The needle thread is then passed through a thread eye of the sewing needle and is ready to sew. In case the sewing machine is provided with a threading mechanism, an automatic threading is performed so that the needle thread is passed through the thread eye.

Various types of sewing machines have been put into practice wherein the needle thread drawn from the thread spool is manually passed through a plurality of predetermined thread passing sections on starting the sewing process. As opposed to this, sewing machines, in which the needle thread drawn from the thread spool is passed through a predetermined thread preparation path in advance and then automatically transferred by the thread transferring mechanism to be passed through a plurality of thread passing sections sequentially.

In case of passing the thread through the thread tension regulator among the plurality of thread passing sections, the thread tension regulator needs to be opened, that is, a pair of thread tension discs need to be spaced apart from each other. For example, in JP-A-2004-24729(entitled SEWING MACHINE WITH THREAD TENSION CONTROL FUNCTION AND THREAD TENSION CONTROL PROGRAM THEREFOR), a thread cassette accommodating a thread spool is detachably attached to a cassette attachment portion; and a thread tension control mechanism and pulse motor etc. is provided to drive the thread tension regulator to open/close. On detaching the thread cassette, the thread tension regulator is switched to an open state by the pulse motor. On the other hand, in case the thread cassette is attached when the thread tension regulator is opened, the pulse motor is driven after the elapse of a predetermined time period and the thread tension regulator is automatically switched to close.

In the sewing device described in the above-noted publication, on attaching the thread cassette, the thread tension regulator is kept open and automatically switched to close after the thread cassette is attached. That is, the opening and closing of the thread tension regulator associated with the attachment of the thread cassette is performed. On attaching the thread cassette, in case the thread is passed though a plurality of thread passing sections, further in case, passing the needle thread through the thread eye of the needle, the sewing device does not change the thread tension applied by the thread tension regulator accordingly.

Therefore, in case of passing the needle thread through the predetermined thread passing sections or threading the sewing thread, if the tension of the needle thread is loosely set, passing the needle thread through the plurality of thread passing sections and the needle threading are likely to fail. Such being the case, on thread passing or needle threading, the provision of such a high thread tension that does not fail the thread passing or needle threading is a possible solution.

However, when a high thread tension is applied, on passing the needle thread through the needle bar thread guide attached on the sewing needle by the threading mechanism, or threading the sewing needle by the needle threading mechanism, the thread supply from the thread spool is stopped and required thread amount cannot be supplied. This not only interrupts the thread passing operations of the threading mechanism but also the needle threading operations of the threading mechanism, in which case also faces problems such as the lack of reliability in performing the thread hook by the thread hooking mechanism and needle threading by the threading mechanism.

SUMMARY OF THE INVENTION

An object of the present invention is to provide a sewing machine, which is capable of reliable thread passing through the thread passing sections by automatically performing the entire needle threading process by applying a suitable tension to the needle thread that correlates with the positioning of the thread displaced by the thread transferring mechanism on performing the thread passing through the plurality of thread passing sections.

A sewing machine of the present invention comprises a needle bar supporting a sewing needle, a thread take-up lever, a needle thread supply, a thread tension mechanism including a thread tension regulator and a thread tension adjusting unit adjusting tension applied by the thread tension regulator, a plurality of thread hooking sections including the thread take-up lever and the thread tension regulator, a needle threading mechanism to automatically pass the needle thread through a thread eye of the sewing needle, a thread transferring mechanism automatically hooking onto the thread hooking sections the needle thread which extends from the thread supply and which is retained in a predetermined thread preparatory path while retaining the needle thread so that the needle thread can be turned over to the needle threading mechanism, and a control unit which controls the thread tension adjusting unit so that tension applied to the needle thread becomes a predetermined tension that correlates with a transfer position of the needle thread transferred by the thread transferring mechanism.

In the above sewing machine, in case of turning over the needle thread, which is retained in the predetermined thread preparation path in advance after being transferred by the thread transferring mechanism and automatically passed through a plurality of thread passing sections sequentially, the thread tension adjustment unit is controlled in correlation with the position of the displaced thread.

BRIEF SUMMARY OF THE INVENTION

Other objects, features and advantages of the present invention will become clear upon reviewing the following description of the embodiment with reference to the accompanying drawings, in which:

FIG. 17 is a table showing the data set on a drive amount table; and

DETAILED DESCRIPTION OF THE INVENTION

Figure 1:
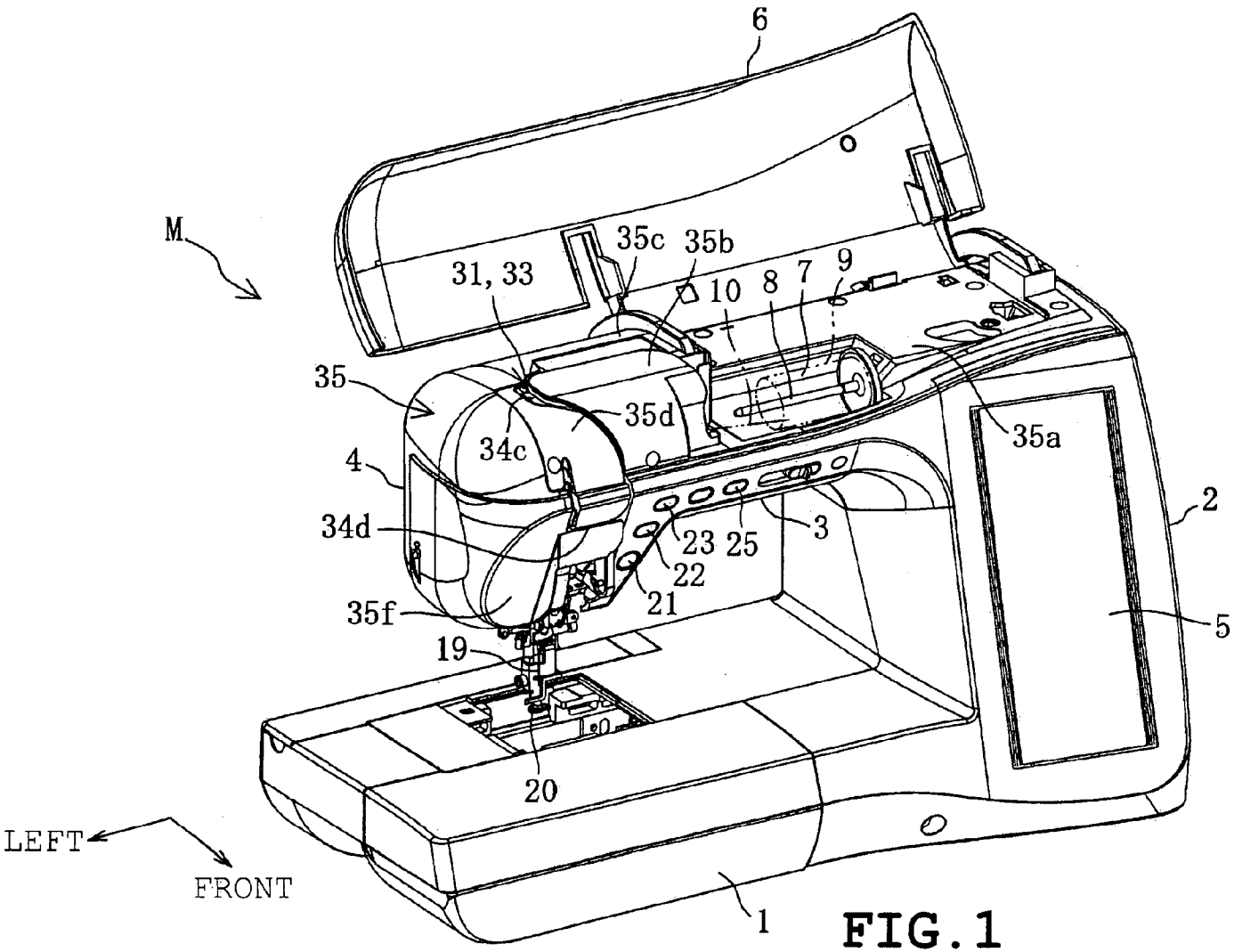
FIG. 1 is a perspective view of a sewing machine of the current invention viewed from the upper side.
Figure 2:
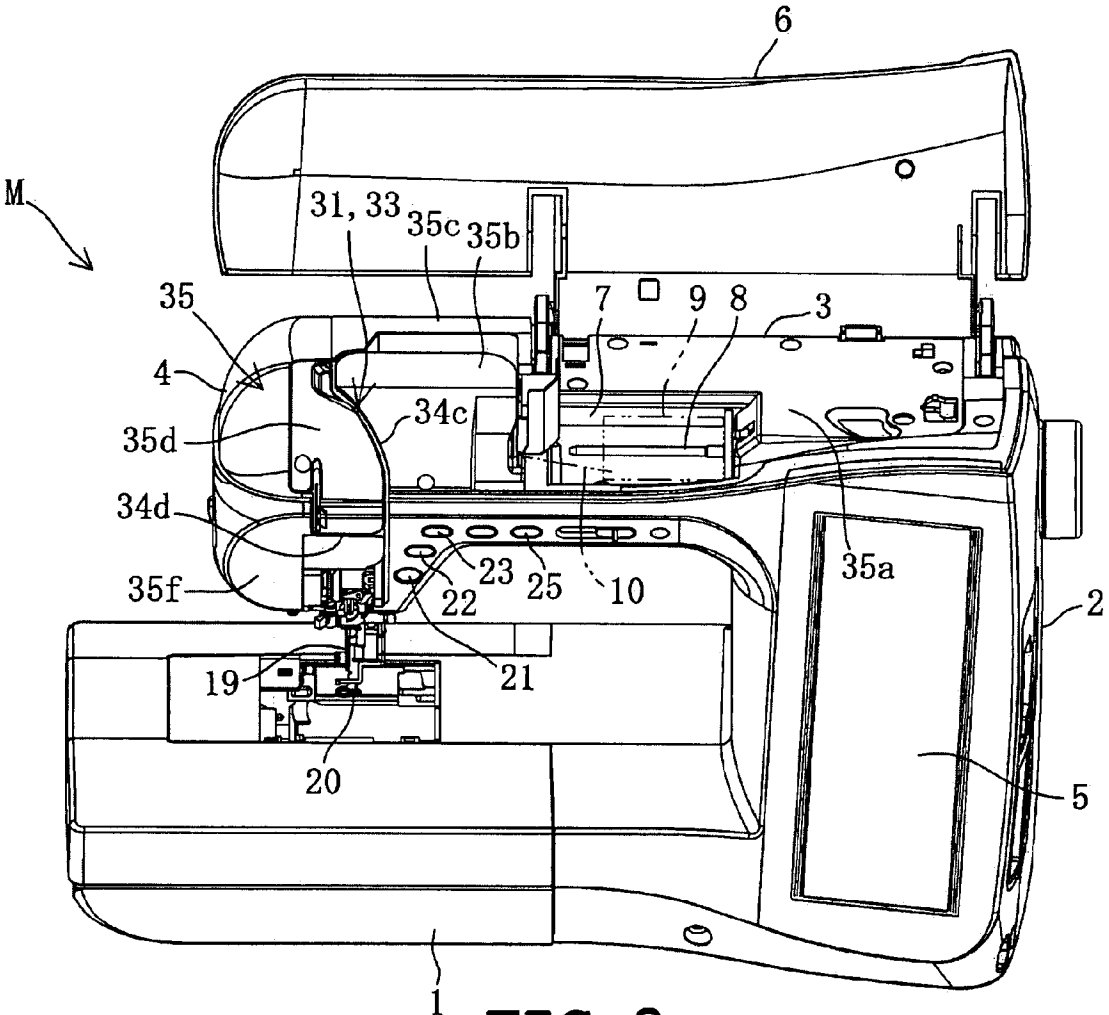
FIG. 2 is a perspective view of the sewing machine viewed from above.
Figure 3:
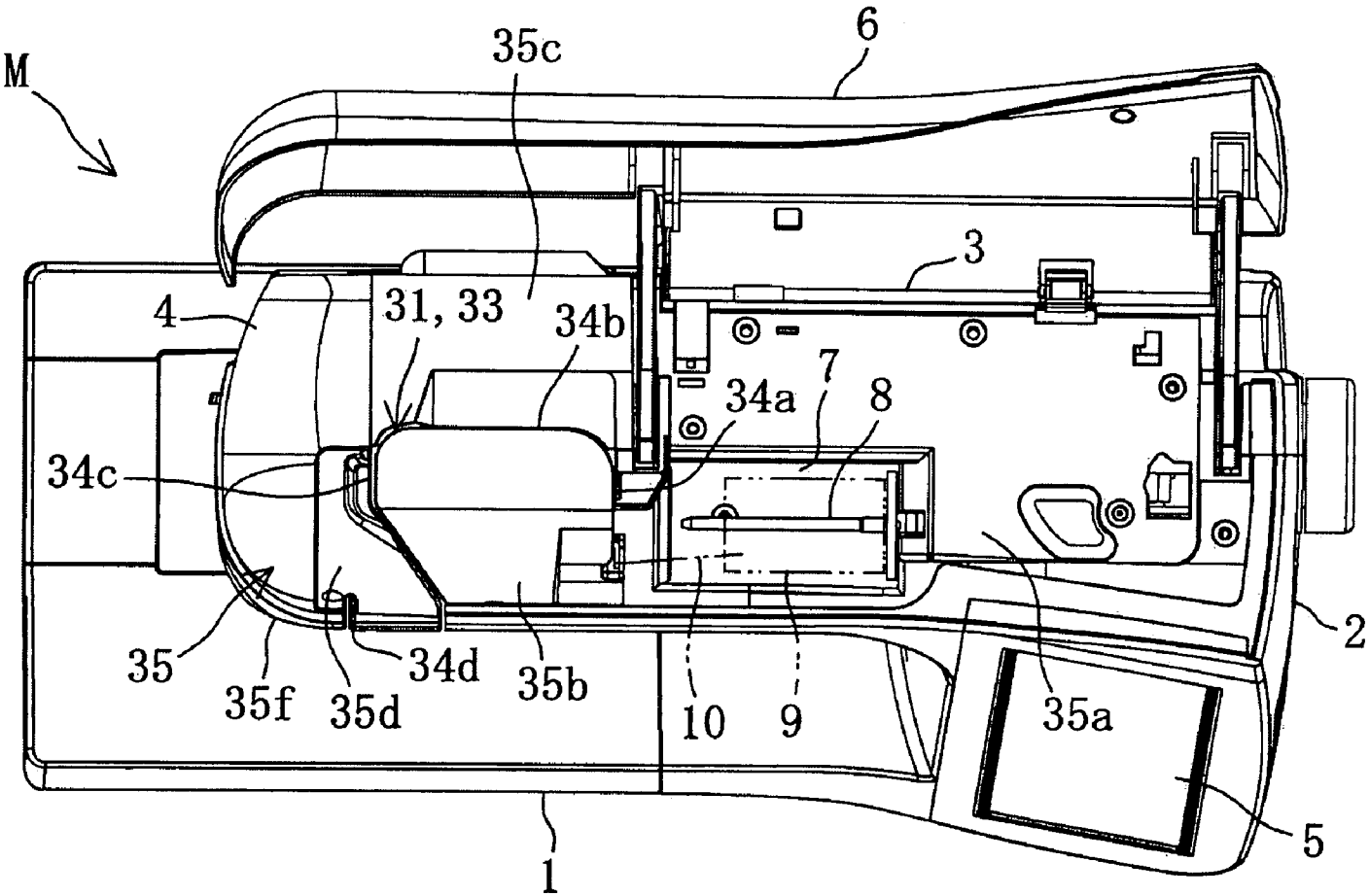
FIG. 3 is a plan view of the sewing machine.
Figure 4:
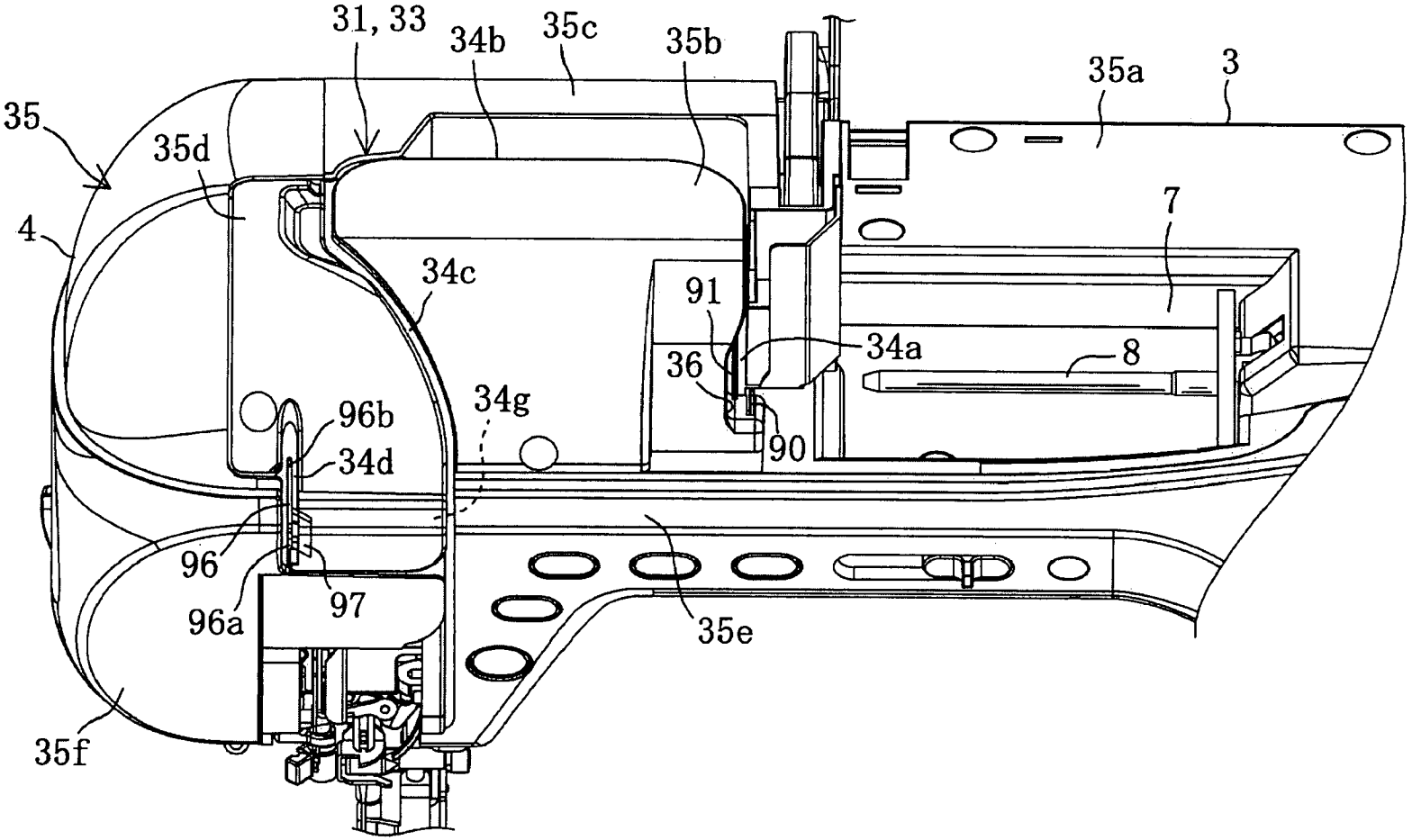
FIG. 4 is an enlarged view of the main part of FIG. 2.

One embodiment of the present invention will be described with reference to the accompanying drawings. As shown in FIGS. 1 to 3, the sewing machine M is provided with a sewing bed 1, a sewing pillar 2 standing on the right side portion of the bed 1, a sewing arm 3 extending to the left from the upper portion of the pillar 2 converging with the bed 1 and a head 4 arranged on the left portion of the arm 3. In the bed 1, a needle plate (not shown) is arranged, under which is a shuttle mechanism (not shown) is arranged. A bobbin on which a bobbin thread is wound is attached to the shuttle mechanism. In front of the pillar, a large vertically long liquid crystal display 5 is arranged.

A cover 6 is mounted in the arm 3 so as to be opened and closed. This openable cover 6 is arranged laterally and entirely across the arm 3 and is pivotally supported about the laterally directed axis in the upper-rear end of the arm 3 in an openable manner. In the right side of the head 4, a thread accommodating concave 7 is formed on top of the arm 3 and a spool pin 8 is arranged in the thread accommodating concave 7.

A thread spool 9, from which the thread is supplied, is mounted on a spool pin 8 and accommodated sideways in the lateral direction in the thread spool accommodating concave 7. The needle thread 10 drawn from this thread spool 9 is supplied to the thread tension regulator 14, take-up spring 15 and thread take-up lever etc. in sequence and is finally supplied to an eye 19*a* arranged in the lower end of a sewing needle 19 (refer to FIGS. 13A and 14A).

As shown in FIGS. 3 to 7, in the head 4, the needle bar 11, a presser foot, the thread take-up lever, the thread tension regulator 14, the take-up spring 15, an automatic thread hooking device 16, and an automatic needle threading mechanism 17 etc. are provided. The needle bar 11 is supported vertically reciprocably by the sewing machine frame and on the lower end of the needle bar the sewing needle is attached as well as the arrangement of a needle bar thread guide 18. This needle bar 11 is vertically driven by the sewing machine drive mechanism (not shown) having a sewing machine motor 28.

Figure 9:
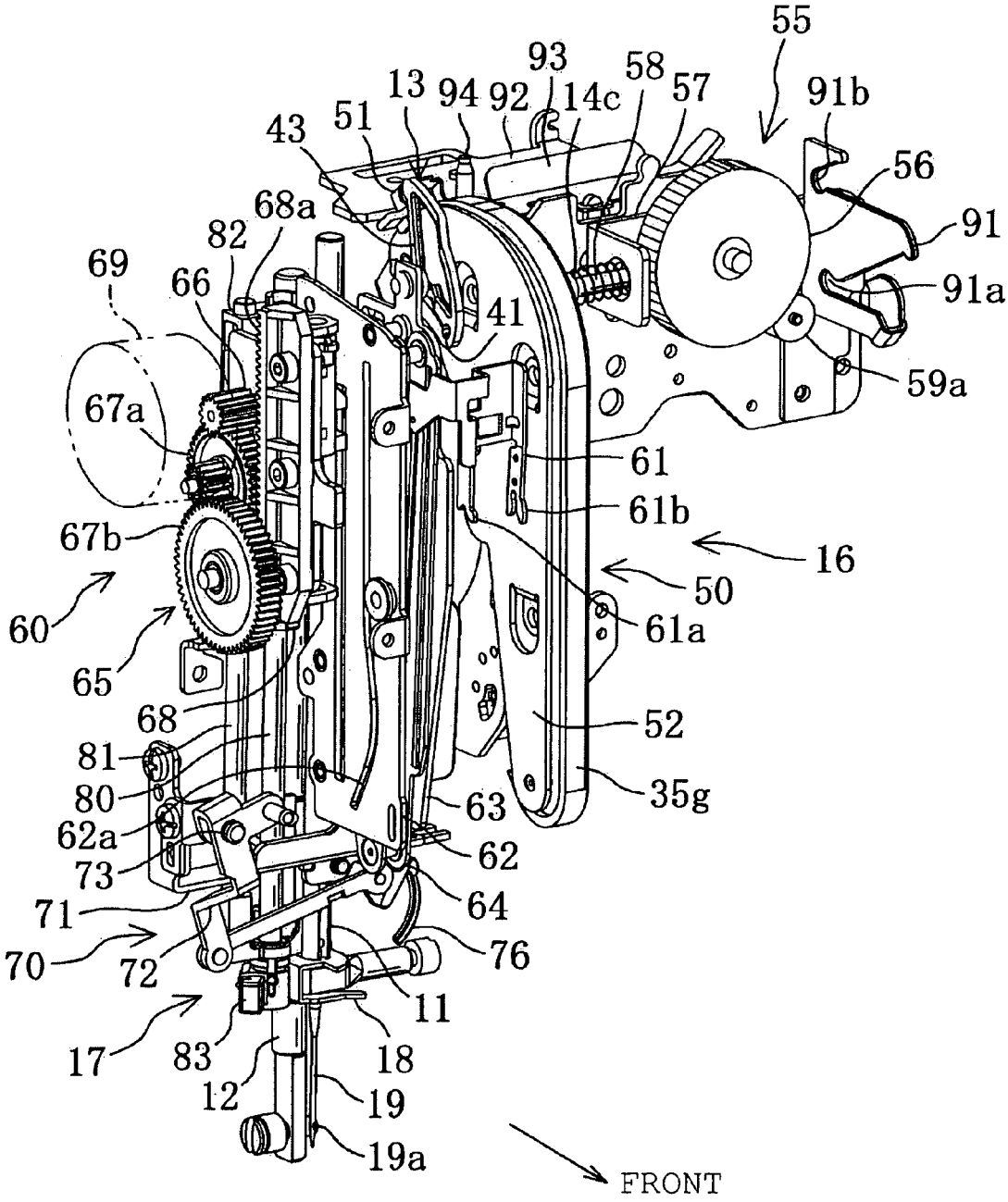
FIG. 9 is a perspective view of the automatic threading device and automatic needle threading mechanism viewed from the upper-left.

The presser bar 12 is located in the rear of the needle bar 11, supported in vertically reciprocable manner. In the lower end of the presser bar 12, a presser foot 20 (refer to FIGS. 9 and 10) is detachably attached. As shown in FIGS. 1 and 2, a sewing start switch 21, sewing finish switch 22, automatic threading preparation switch 23 and automatic threading start switch 25 are arranged in a single line in the front side of the arm 3.

Figure 5:
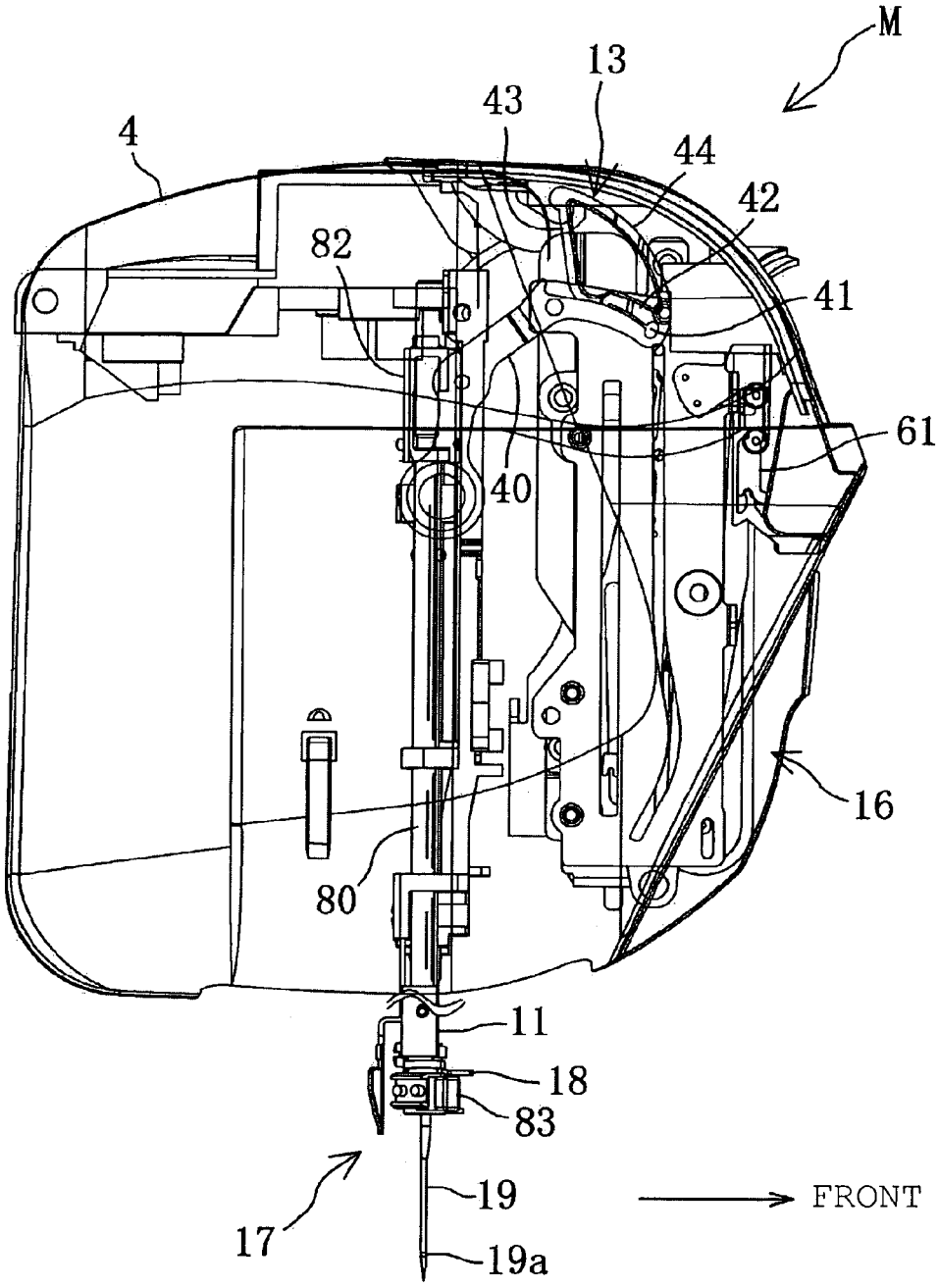
FIG. 5 is a transparent left side view of the sewing machine (automatic thread passing enabled)
Figure 6:
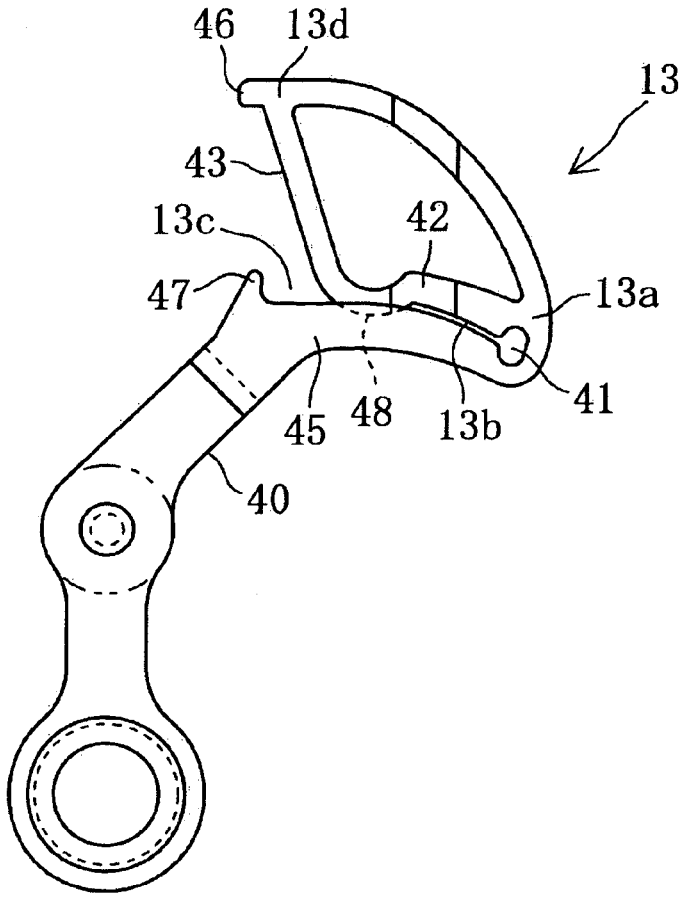
FIG. 6 is a left side view of a thread take-up lever.
Figure 7:
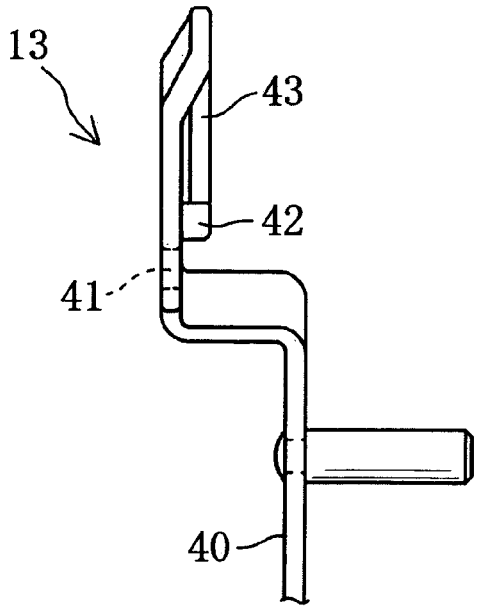
FIG. 7 is a front view of the thread take-up lever.

As shown in FIGS. 5 to 7, the thread take-up lever 13 is arranged in the front and upper side of the needle bar 11 and as indicated hereinafter, is pivotally supported in a rotatable manner about an axis oriented in the lateral direction of the sewing machine frame. The thread tension regulator 14 having a pair of thread tension discs 14*a*, 14*b* is arranged in a lateral direction, in the thread spool 9 side (upstream with respect to the thread take-up lever 13) which is located to the right of the thread take-up lever 13.

Now, the sewing machine M as shown in FIGS. 1 to 8, 13A and 14 is provided with a thread preparation path 30 and a thread guide groove 31. The thread preparation path 30 is for arranging the needle thread 10, which is drawn from the thread spool 9 mounted on a spool pin 8 so that the needle thread 10 can be passed, and also for preparing the needle thread 10 so that needle thread 10 can be automatically threaded into the eye 19*a* of the sewing needle 19 by the automatic needle threading mechanism 17.

The thread guiding groove 31 is described hereafter. As shown in FIGS. 1 to 4, the sewing machine cover 35 covering the top of the arm 3 has cover parts, which are divided into a plurality of covers such as an upper cover 35*a*, thread front guide cover 35*b*, rear cover 35*c*, thread guide cover 35*d*, front cover 35*e* arranged on a large area of the lower-front portion of the arm 3 and a large type face plate 35*f* arranged on a large area of the head 4. The aforementioned thread spool accommodating concave portion 7 is formed on the upper cover 35*a*. The left end of the upper cover 35*a* is located in the lateral center of the arm 3. An introductory groove 34*a* is formed in between the upper cover 35*a* and front introductory cover 35*b* and the introductory groove 35*b* is formed in between the front introductory cover 35*b* and the rear cover 35*d* arranged in its rear. Further, a curved introductory groove 34*c* is formed in between the thread guide cover 35*d* and the front introductory 35*b* located to its right and the front cover 35*e* and an L-shaped introductory groove 34*d* is formed in between the thread guide cover 35*d* and the face plate 35*f* located under and to its lower left. These introductory guides 34*a*, 34*b* and 34*c* form a linear connection and the introductory groove 34*d* is connected to the lower end of the introductory groove 34*c*. The thread introductory groove 31 is configured from a plurality of introductory grooves 34*a*, 34*b* and 34*c*.

Now, brief explanation on the thread take-up lever 13 is given hereinafter. As shown in FIGS. 5–7, the entire figure of the thread take-up lever 13 is of a reverse V shape when viewed from the side, while it is formed in a crank when viewed from the front. The thread take-up lever 13 is driven by the aforementioned sewing machine drive to swing in the vertical direction. The thread take-up lever 13 comprises a thread passing section 41 formed integrally with the thread take-up lever main body 40, thread take-up lever thread introduction 42 and an introductory guide 43 to guide the needle thread 10 into thread take-up lever thread introduction 42. The thread take-up lever thread passing section 41 is a small oblong thread hole provided on the thread take-up lever end point 13*a* and it connects to the thread introductory groove 13*b* configured from a gap formed by the thread receiver 45 bridging the thread take-up lever main body 40 and thread take-up lever end point 13*a* and the thread take-up lever introduction 42. The needle thread 10 is guided to the thread take-up lever thread passing section 41 passing through thread introductory groove 13*b*. The introductory guide 43 is formed in a straight line of a length nearly equal to the length from the thread introductory opening 13*c*, which is the opening end of the thread introductory groove 13*b* to the thread take-up lever introduction 42 and angled and inclined by 120 degrees from the thread receiver 45.

On the end 13*d* of the introductory guide 43, the first lock 46 is formed to lock the needle thread so that it does not come off to the opposite side of the thread receiver 45. Also, on the base end of the thread receiver 45, the second thread lock 47 is formed to lock the needle thread 10, so that it does not come off to the opposite side of the thread take-up lever thread introduction 42.

Also, in the connection of the thread take-up lever introduction and introductory guide 43, a protrusion 48 protruding to the thread receiver 45 is formed to overlap with the thread receiver 45, when viewed from the side. This protrusion 48 prevents the needle thread 10 introduced into the thread take-up lever thread hook 41 from coming off through the thread receiver 45 and thread take-up lever introduction 42.

Now the sewing machine M, as shown in FIG. 5, is capable of passing the needle thread 10 through the thread preparation path 30 with the thread take-up lever 13 positioned in the thread hook position near the upper limit position. As shown in FIG. 5, when the thread take-up lever 13 is shifted to the thread hook position, the introductory guide 43 is inclined by 80 degrees from the horizontal direction forming a slope declining to the forward direction. The thread take-up lever introductory 42 is inclined by 20 degrees from the horizontal direction so that it is in a downward slope declining in the forward direction. The needle thread 10 in the thread preparation path 30 is passed from the rear of the introductory guide 43.

Next, the automatic thread hook device is described herein under. As shown in FIGS. 8, 9, 11*a* to 11F, 12A to 12F and 13A to 13F, the automatic thread hook device 16 comprises a first thread transferring mechanism 50 having a first thread transferring member 51, a first stepping motor 54(serves as a first drive means) to actuate the first thread transferring mechanism 50, a second thread transferring mechanism 60 having a second thread transferring member 61, and a second stepping motor 69(serves as a second drive means) to actuate the second thread transferring mechanism 60. The first thread transferring member 51 is a member which carries the needle thread 10 preset on the thread preparation path 30 and passes the needle thread through a plurality of thread passing sections (thread tension regulator 14, take-up spring 15 and thread take-up lever 13). The second thread transferring member 61 is a member which carries the needle thread in the downstream of the thread take-up lever to the sewing needle 19. The thread transferring mechanism in this case is configured from the first thread transferring mechanism 50 and the second thread transferring mechanism.

In the first thread transferring mechanism 50, the first thread transferring member 51 hooks the needle thread in the upstream of the introductory guide 43 of the thread take-up lever 13, carries it toward the take-up spring 15 while hooking the needle thread 10 onto the thread tension regulator 14. Once the first thread transferring member 51 reaches the take-up spring 15, it hooks the needle thread 10 onto the take-up spring 15. In the first and second thread transferring mechanism 50, 60, the first and second thread transferring member 51, 61 hooks the needle thread 10 onto the thread take-up lever thread hook 41 while carrying the needle thread 10.

Figure 11A:
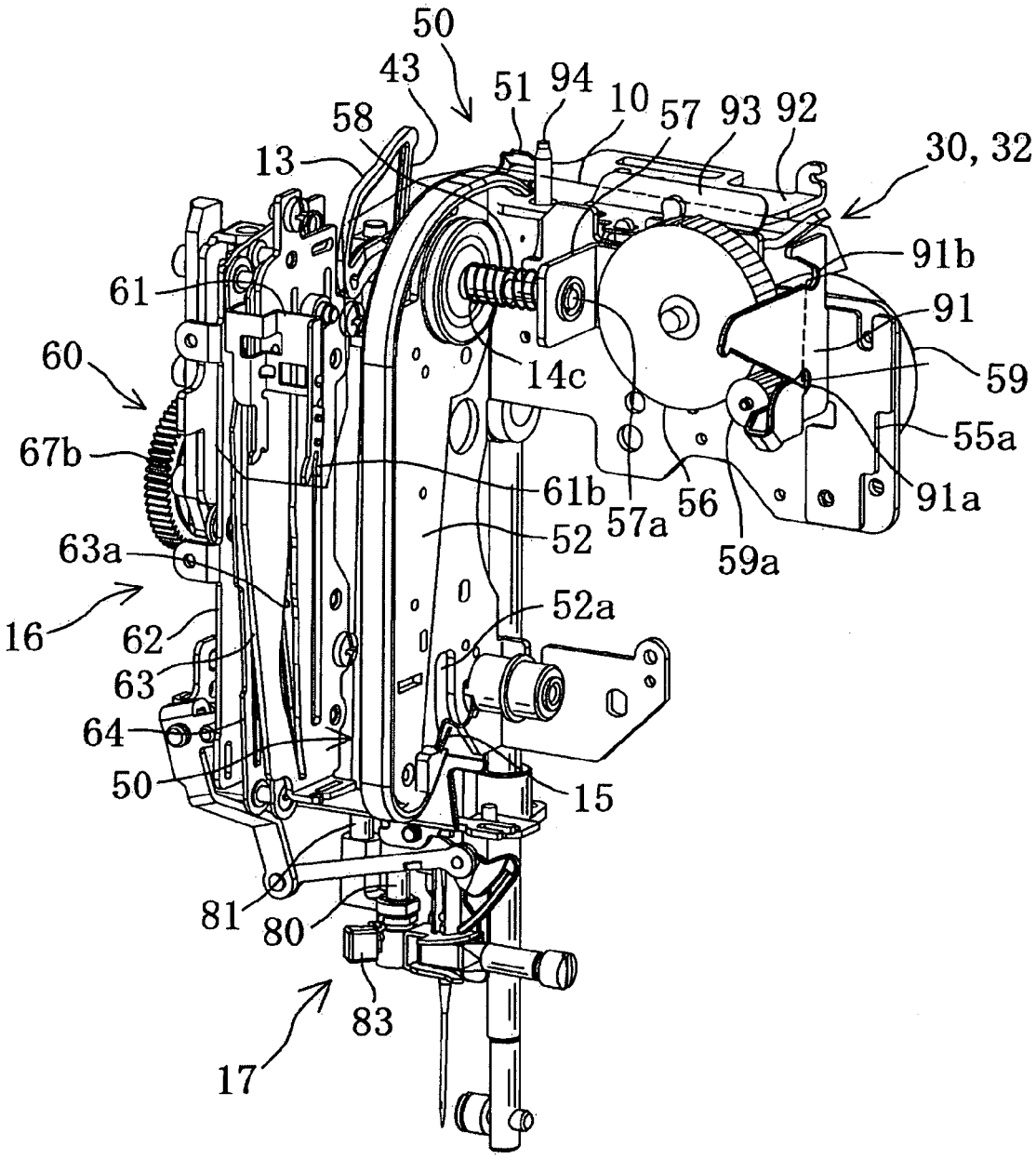
FIG. 11A is a perspective view of the automatic threading apparatus and automatic needle threading mechanism (stand-by)
Figure 12A:
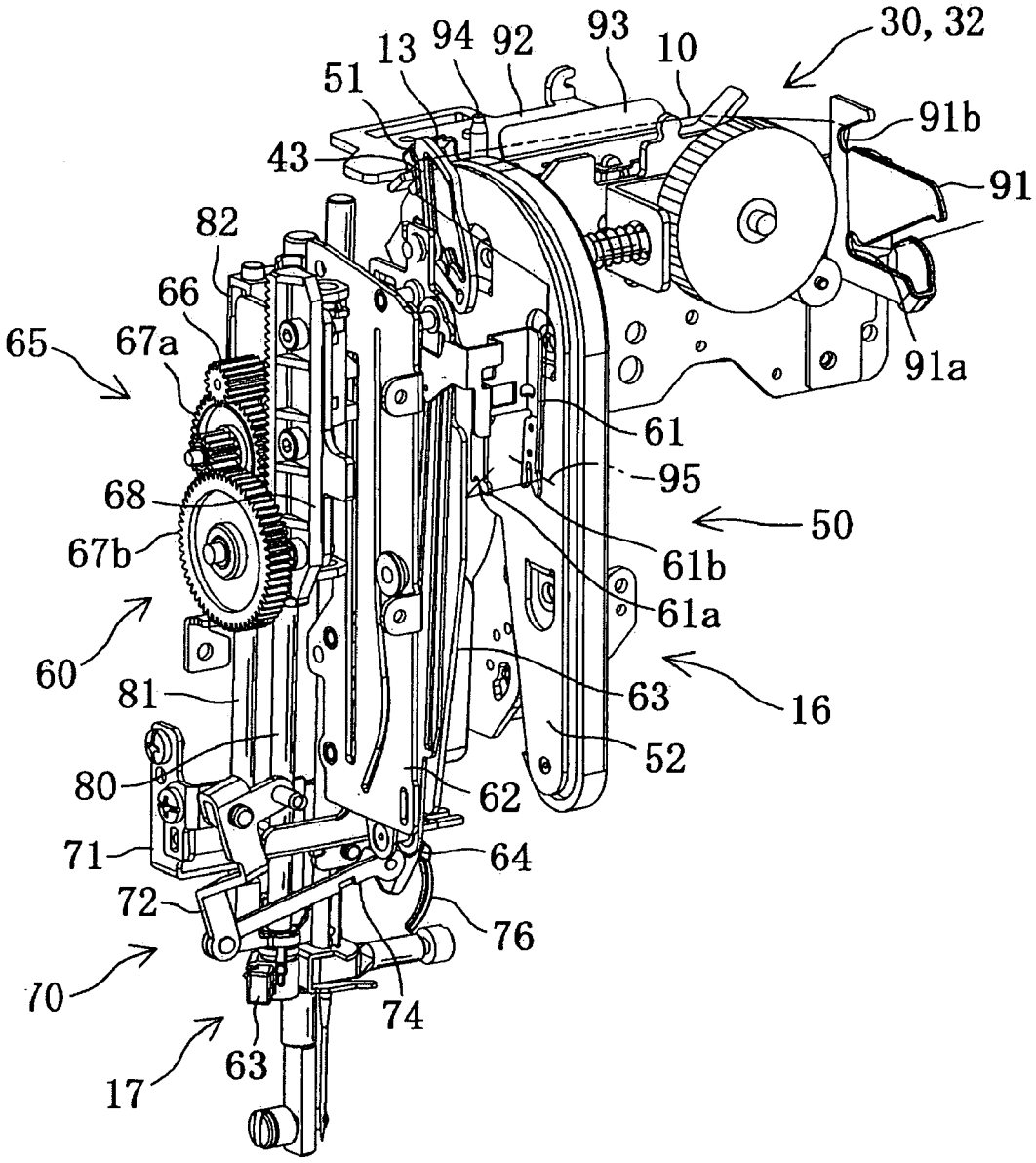
FIG. 12A is a perspective view of the automatic threading apparatus and automatic needle threading mechanism (stand-by)
Figure 12B:
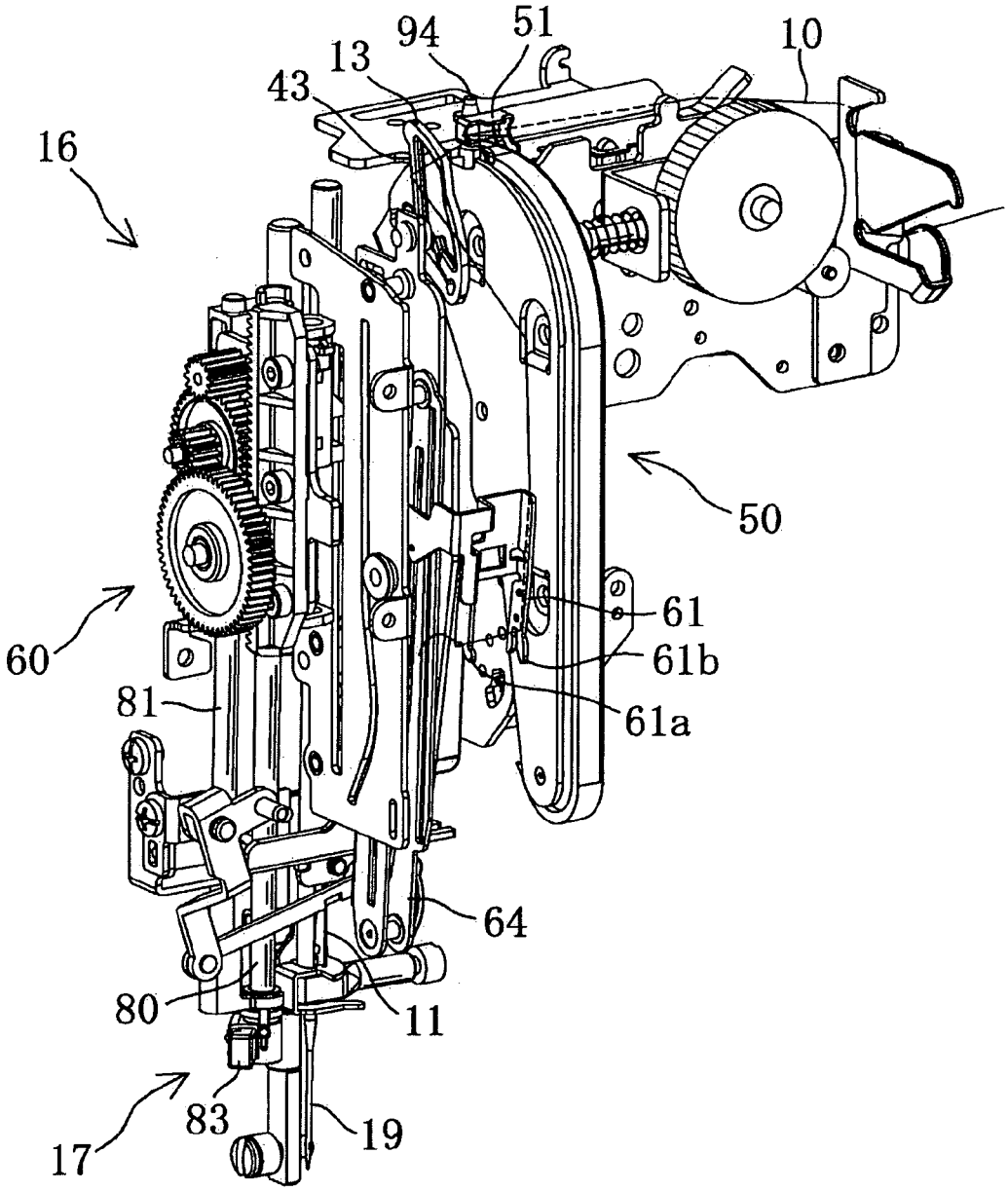
FIG. 12B is a perspective view of the automatic threading apparatus and automatic needle threading mechanism (thread passed)
Figure 12C:
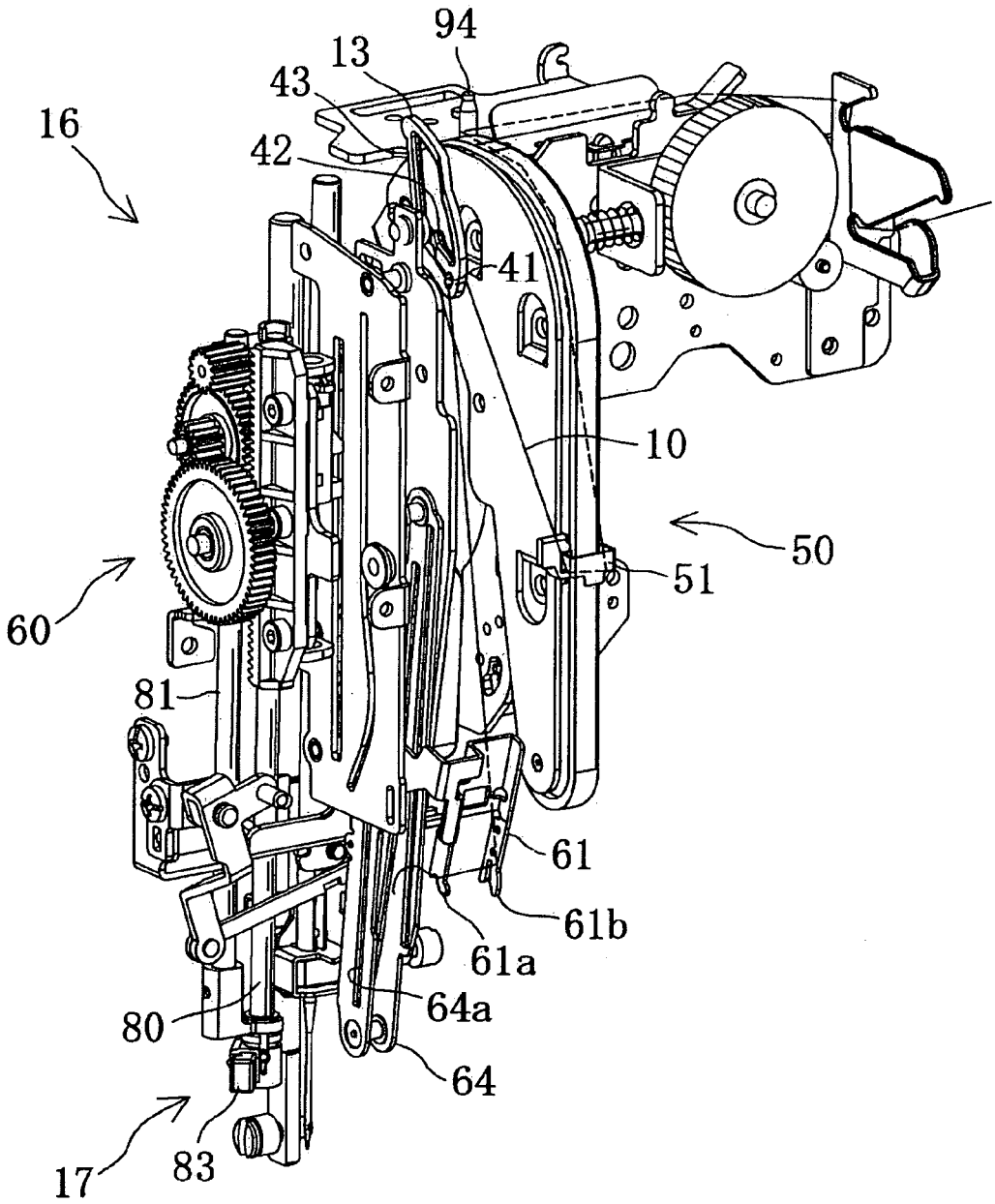
FIG. 12C is a perspective view of the automatic threading apparatus and automatic needle threading mechanism (thread passed through a thread take-up lever)
Figure 12D:
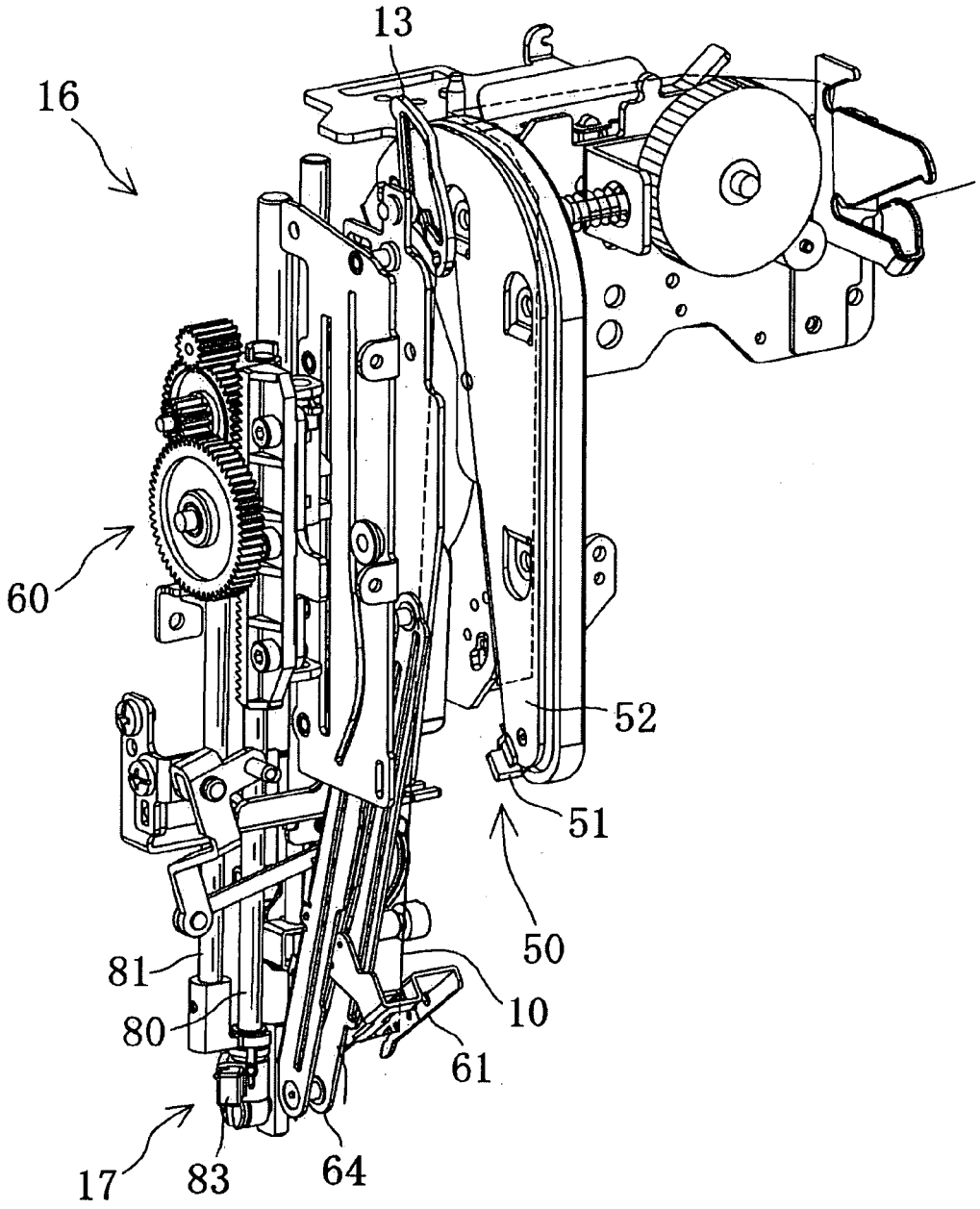
FIG. 12D is a perspective view of the automatic threading apparatus and automatic needle threading mechanism (check spring)
Figure 13A:
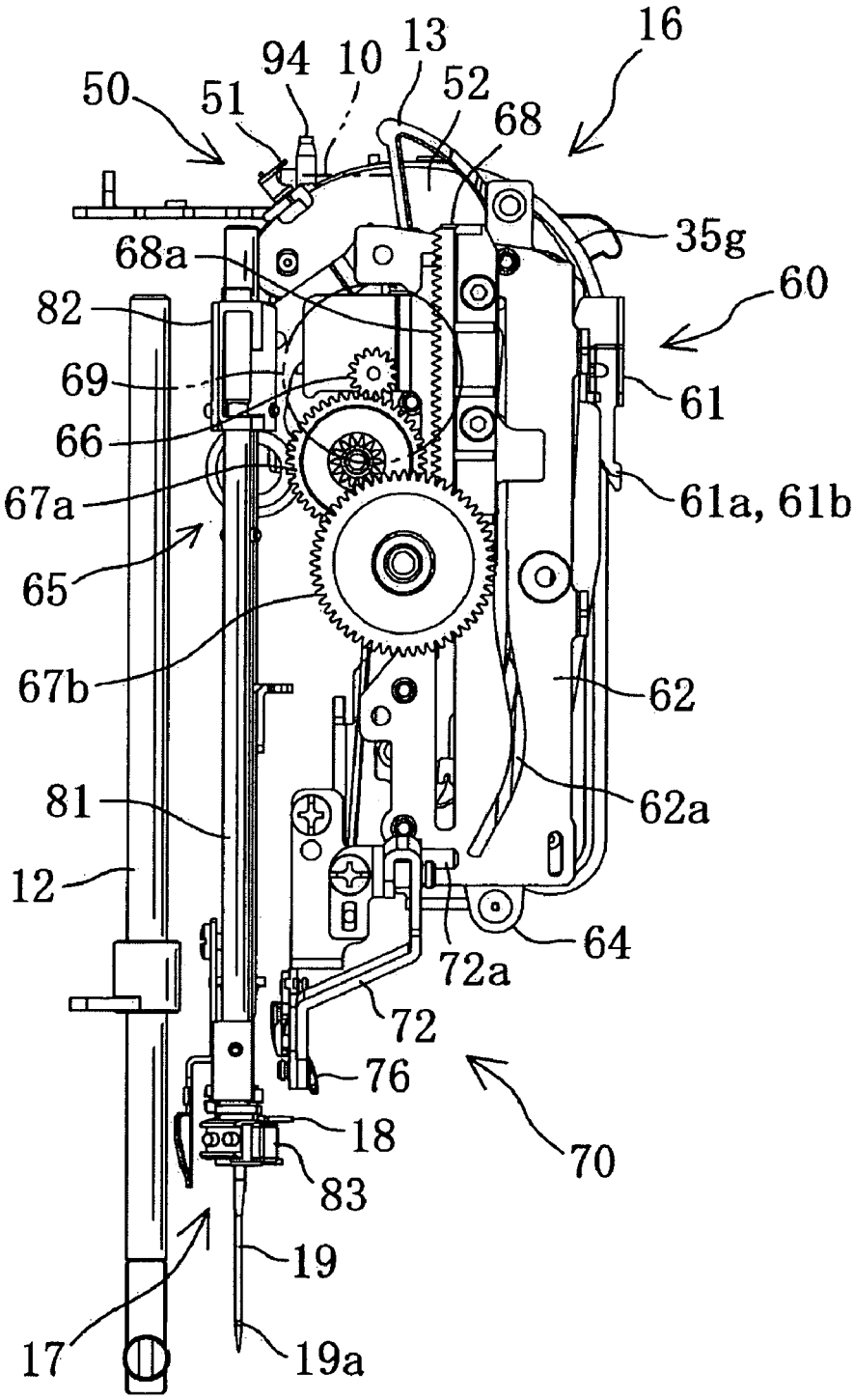
FIG. 13A is a side view of the automatic threading apparatus and automatic needle threading mechanism (stand-by)

The first thread transferring mechanism 50 is provided with: a first guide frame 52 fixed on the sewing machine frame; the first thread transferring member 51 which is guided and supported by the first guide frame and vertically moveable across the stand-by position shown in FIGS. 11A, 12A, and 13A and the thread turnover position shown in FIG. 1D, 12D and the first drive mechanism (not shown) which actuates the first thread transferring member 51.

The first guide frame 52 is fixed on the right side of the needle bar 11 and the thread take-up lever 13 in a vertical position and it is of a vertically long plate frame with its surface facing the lateral direction. The first guide frame 52 is formed in a series of large-diameter circular arc on the upper edge, a long vertically extending linear front edge, and a small-diameter circular arc on the lower edge. On the upper end portion of the right hand surface of the first guide frame 52, thread tension disks 14*a* and 14*b* are mounted via a thread tension axis and on the lower end portion of the first guide frame 52, a take-up spring 15 energized by a spring is mounted. On the lower portion of the first guide frame 52, a notch 52*a* is formed concaving inwardly from the lower end to the upper end, and the take-up spring 15 is faced toward it. The take-up spring 15 is arranged to fulfill the thread capturing function on the needle thread 10 engaged from below via the notch 52*a*.

Figure 8:
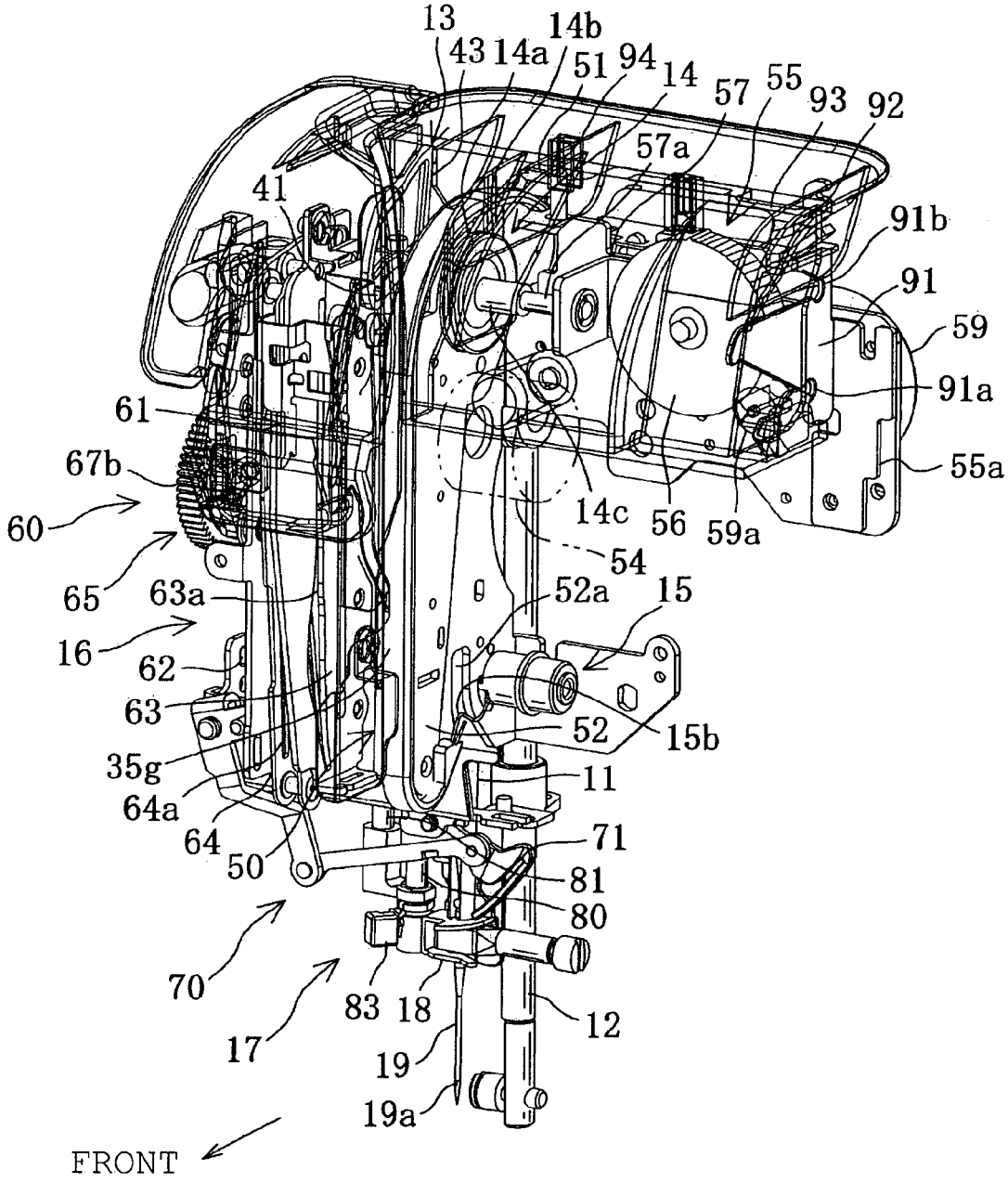
FIG. 8 is a perspective view of an automatic threading apparatus and automatic needle threading mechanism viewed from the upper-right.
Figure 15A:
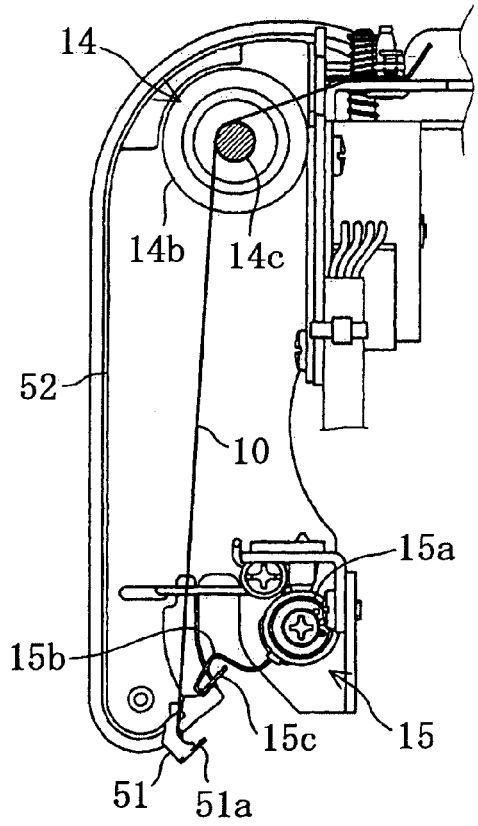
FIG. 15A is a right side view of a first guide frame immediately before the needle thread is passed through a thread take-up spring.
Figure 15B:
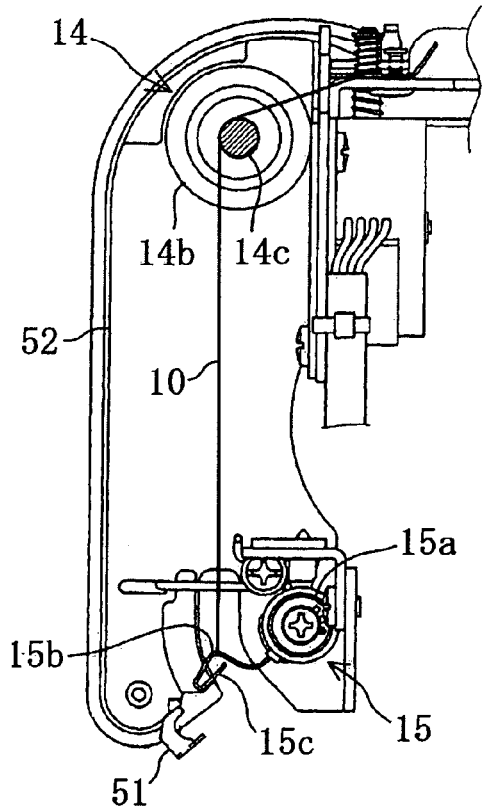
FIG. 15B is a right side view of a first guide frame with the needle thread passed through the thread trimming spring.

The take-up spring 15 is described hereunder. As shown in FIGS. 8, 15A and 15B, the take-up spring 15 is provided in the lower end of the first guide frame 52. This take-up spring 15 is integrally provided with a cylindrical coil 15*a* containing a winding spring, thread hook 15*b* extending from the coil 15*a* in a bent form and a thread introduction 15*c* to introduce the needle thread into the thread hook 15*b*. The first guide frame 52 as shown in FIGS. 11A, 12A and 13A, the stand-by position of the first guide frame 52 is the transfer start position in the upper end rear of the first guide frame 52.

As shown in FIGS. 11D, 12D, 13D and 15A, the thread turnover position of the first thread transferring member 51 is the transfer finish position in the lower end rear of the first guide frame 52. Therefore, the first thread transferring member moves uninterruptedly from the stand-by position in the upper side to the thread turnover position in the lower side along the upper edge, front edge and lower edge of the first guide frame. In the first thread transferring member 51, a thread hooker 51*a* protruding forward in the stand-by position and the foot supporting the thread hooker 51*a* is formed respectively. The first thread transferring member 51 is guided and supported moveably from the stand-by position to the thread turnover position by the engagement of the foot and the edge of the first guide frame 52.

On moving from the stand-by position to the thread turnover position, the first thread transferring member 51 moves downward while hooking a part of the needle thread 10 already hooked on the thread preparation path 30 onto the thread hooker 51*a* and hooks the needle thread located upstream with respect to the first transferring member 51 onto the thread tension regulator 14. The first thread transferring member 51 is halted when reaching the thread turnover position in the lower side.

As described above, when the thread transferring is halted, that is, finished in the first timing, in which the first thread transferring member 51 reaches the thread turnover position the needle thread is removed from the thread hooker 51*a* and is carried directly below the thread introduction 15*b* of the take-up spring. Then, because the second thread transferring member 61 described hereinafter continues to move downward, the needle thread 10 is pulled towards the second thread transferring member 61 by the movement of the second thread transferring member 61. Then the needle thread 10 is introduced to the notch 52*a* from the lower end and hooked on the thread hooker 15 from the thread introduction 15*c*.

The first drive mechanism not shown is provided with an endless timing belt joined to the first thread transferring member 51 and a guide groove not shown to guide the timing belt along the upper edge, front edge and the lower edge of the guide frame. In the first drive mechanism, the first thread transferring member 51 is driven from the stand-by position to the thread transfer position by driving the timing belt in as recycling manner by the first stepping motor 54 (refer to FIG. 8).

Next, the thread tensioning mechanism 55 having a thread tension regulator 14 is described. The thread tensioning mechanism 55 is provided with a pair of thread tension disks 14*a* and 14*b* to sandwich the needle thread 10 in order to apply tension, a compressed coiled spring 58 to urge the fixed thread tension disk 14*a* against the moveable thread tension disk 14*b*, a tension adjusting mechanism to variably adjust the elasticity of the compressed coiled spring 58, and a thread tension stepping motor 59 to actuate the tension adjusting mechanism. The thread tension adjusting unit is configured from the tension adjusting mechanism and thread tension stepping motor 59 etc.

Referring to the tension adjusting mechanism, on the upper end of the first guide frame 52, a laterally directed mounting plate 55*a* is fixed and a circular tension adjustment gear 56 is rotatably pivoted on the longitudinally directed pivotal axis fixed on the mounting plate 55*a*. On the rear surface of the tension adjusting gear 56, a circular-arc cam (not shown) forming a part of the spiral is formed. On the circular-arc cam, the right end of a thread tension plate 57(L-shaped in flat view) is engaged and a left directed spring receptor pin 57*a* is fixed on the thread tension plate 57. The end (left end) of the spring receptor pin 57*a* is partly fitted inside the thread tension axis 14*c* fixed on the first guide frame 52 and the compressed coiled spring 58 is placed in between the thread tension disk 14*b* and the thread tension plate 57. The thread tension stepping motor 59 is fixed by the mounting plate 55*a* from the rear side. The drive gear 59*a*, to which the tension adjusting gear 56 is fitted is fixed on the drive axis penetrating the mounting plate 55*a*. Therefore when the thread tension stepping motor 59 is actuated, the tension adjusting gear 56 is rotationally driven via the drive gear 59*a*.

Now, in case the thread tension stepping motor 59 is set in a standard position by the initial settings, the tension of the thread tension regulator 14 is zero or lower, that is, the 2 thread tension disks 14*a* and 14*b* are spaced apart. In a ROM 100*b* in a microcomputer 100 described hereinafter, In case of performing the thread passing by the automatic thread hooking device 16, when the thread tension stepping motor 59 is driven, the drive pulse count of the thread tension stepping motor 59 that adjusts the tension by the thread tension regulator 14 to approximately zero is stored in a ROM 100*b* in a microcomputer 10. The ROM 100*b* also stores the drive pulse count of the thread tension stepping motor 59 that slightly operates the tension (for example 10*g f*) by the thread tension regulator 14 as a drive amount table.

The slight tension applied when the thread tension regulator 14 is closed is set to a value smaller than the thread tension (for example, set suitably in the range of 30 to 100 g f) operated on the needle thread 10 during embroidery. Therefore, not only is the drive control of the thread tension stepping motor 59 adjusting the tension generated by the tension regulator 14 simplified, but the rapidity of the open-close switching of the thread tension regulator 14 is improved.

The second thread transferring mechanism 60 comprises a laterally paired second guide frame 62, 63 fixed in parallel on the sewing machine frame, a moveable frame 64 guided and supported by the second guide frames 62 and 63, the second thread transferring member 61 guided and supported by the moveable frame and a second drive mechanism 65 to actuate the moveable frame 64 and the second thread transferring member 61. The moveable frame 64 is moveable across the retracted position shown in FIGS. 11A and 12A, and the protruding position shown in FIGS. 13A, 11E, 12E and 13E. The second thread transferring member 61 taken together with the movement of moveable frame 64 is moveable across the stand-by position shown in FIGS. 1A, 12A and 13 and the thread transfer position shown in FIGS. 11E, 12E and 13E.

The second guide frames 62 and 63 each of a long vertically extending plate frame having a laterally directed surface are arranged on the left-hand side of the needle bar 11 and the thread take-up lever 13. The second guide frames 62 and 63 are arranged facing each other and are spaced apart in a predetermined distance. In between the 2 guide frames 62 and 63, the moveable frame 64 is provided so as to protrude and retract. The moveable frame 64 is structured by thin long laterally paired and converging moveable pieces connected together and the second thread transferring member 61 is moveably supported on to the moveable fame 64 via its support section 61.

Figure 11E:
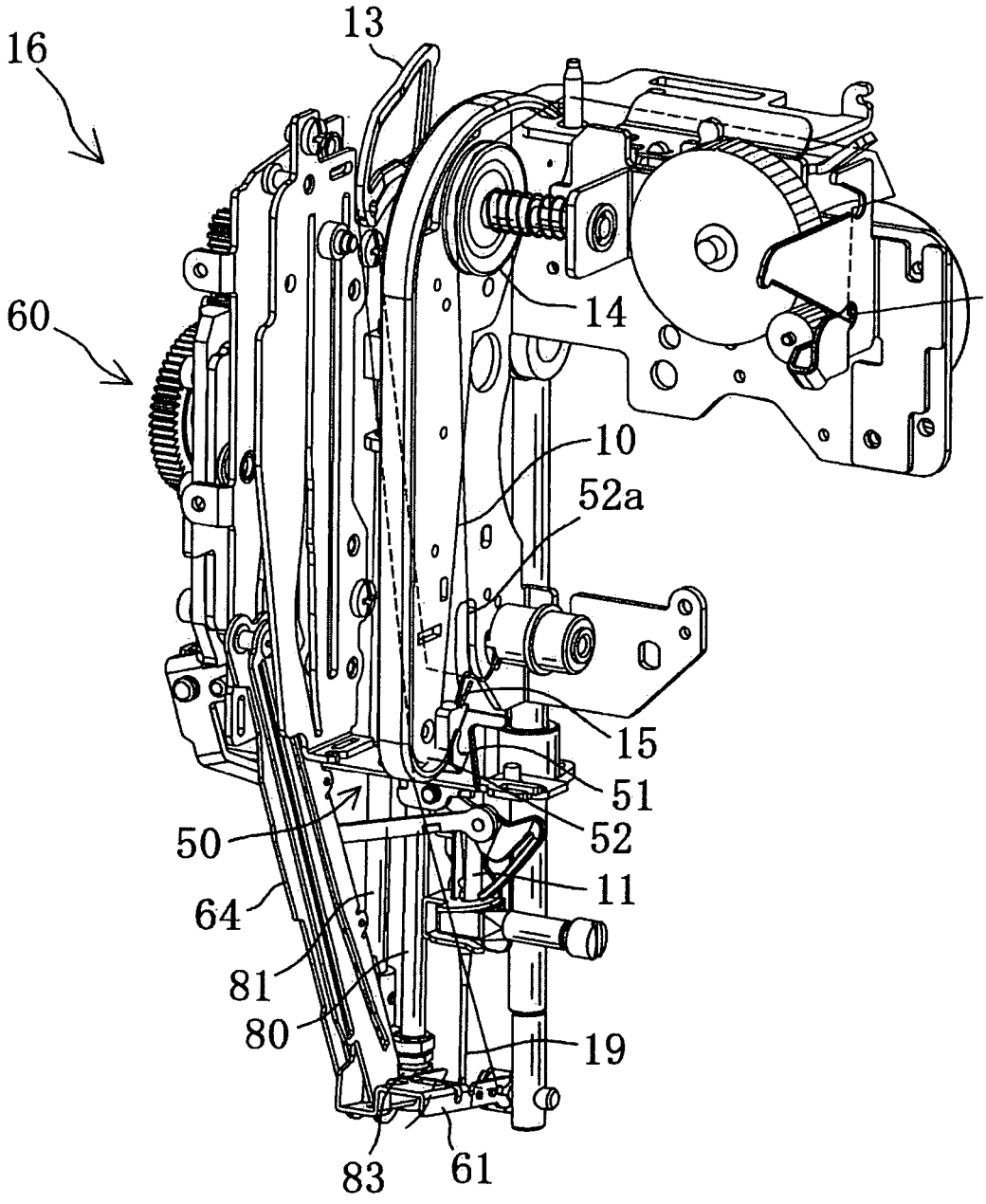
FIG. 11E is a perspective view of the automatic threading apparatus and automatic needle threading mechanism (thread turnover)
Figure 11F:
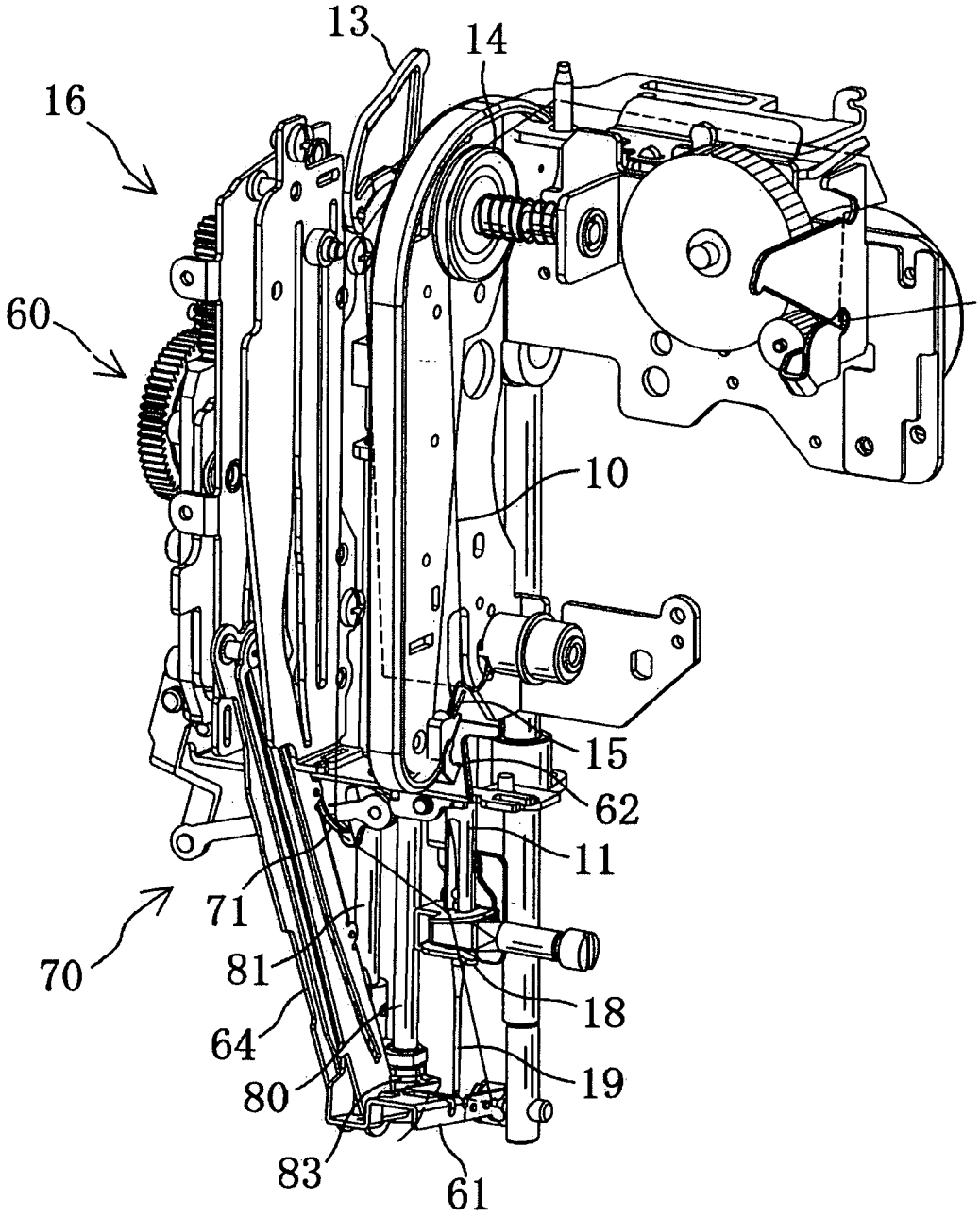
FIG. 11F is a perspective view of the automatic threading apparatus and automatic needle threading mechanism (thread passed through a needle bar)
Figure 12E:
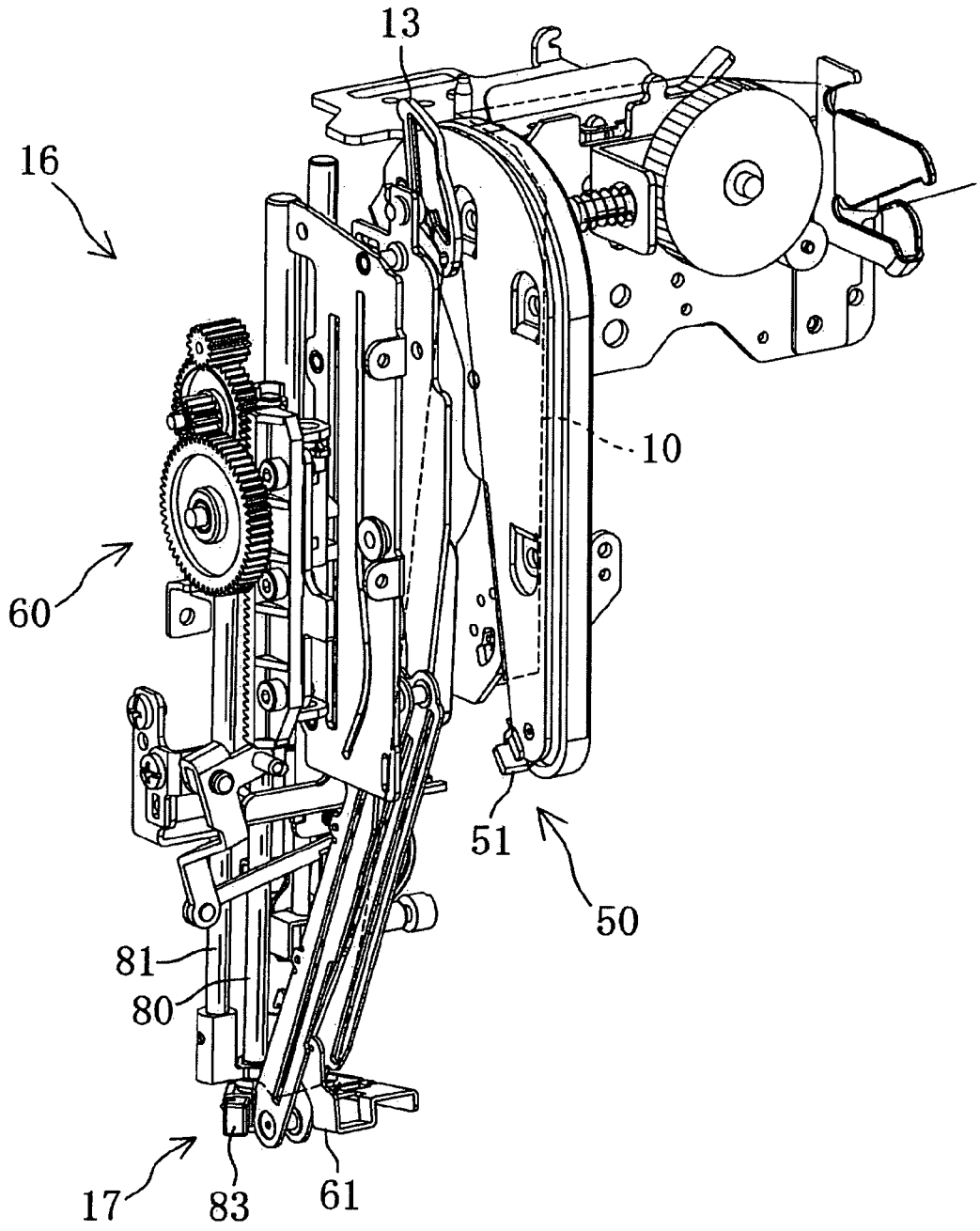
FIG. 12E is a perspective view of the automatic threading apparatus and automatic needle threading mechanism (thread turnover)
Figure 12F:
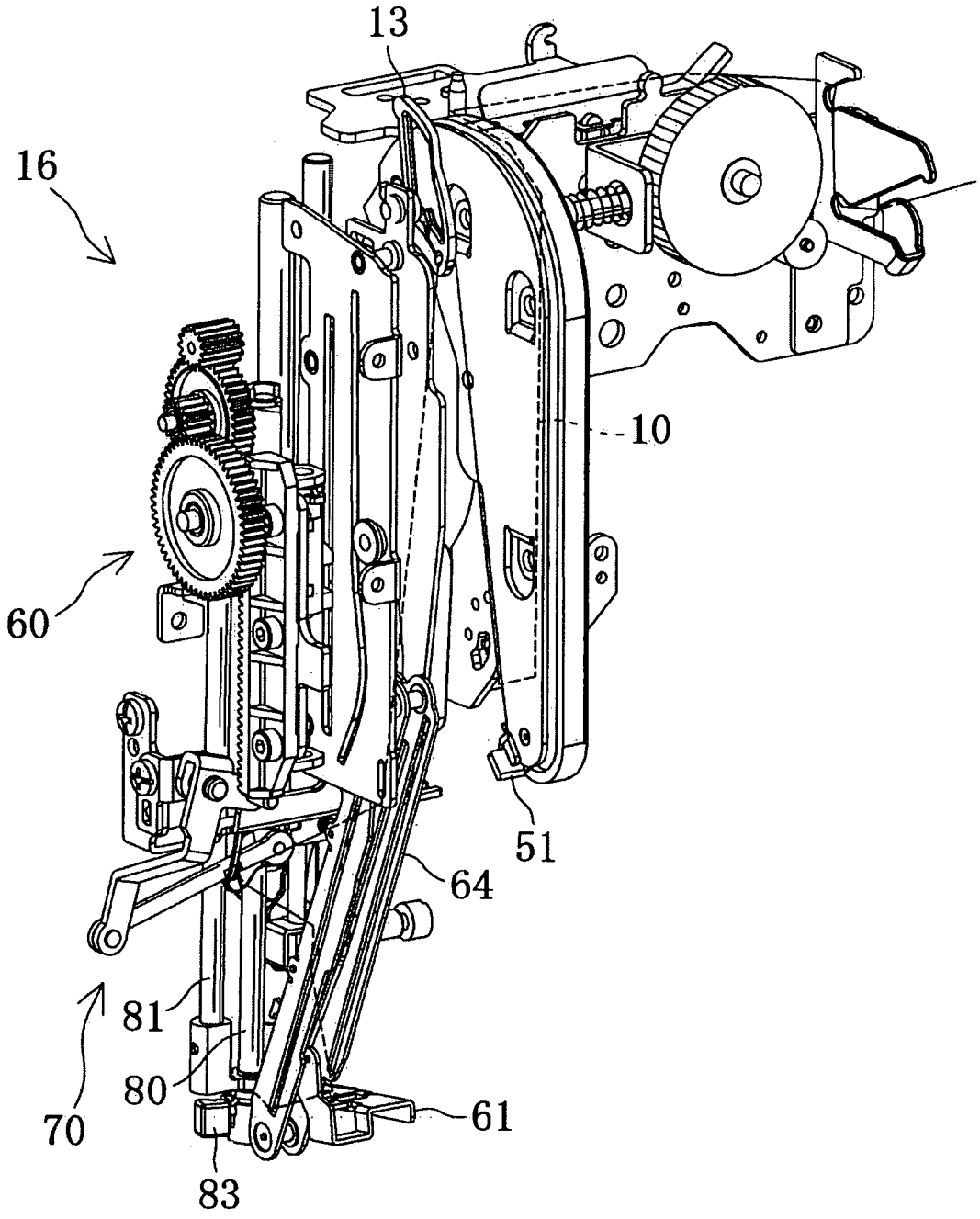
FIG. 12F is a perspective view of the automatic threading apparatus and automatic needle threading mechanism (thread passed through a needle bar)

Vertical guide grooves 62*a* and 63*a* are formed on the second guide frame 62 and 63 respectively and the moveable frame 64 is moveably guided by these guide grooves 62*a* and 63. Also, on one of the moveable pieces of the moveable frame 64, the second thread transferring member 61 is supported via a support section 61*c*. As shown in FIGS. 11A, 12A and 13A, when the second thread transferring member 61 is in the stand-by position, it is faced downward located immediately in the front and below the thread take-up lever which is shifted to the thread hook position. As shown in FIGS. 11E, 12E and 13E the second thread transferring member 61, when in the thread turnover position is rear faced in a horizontal disposition in front of the sewing needle 19.

Figure 10:
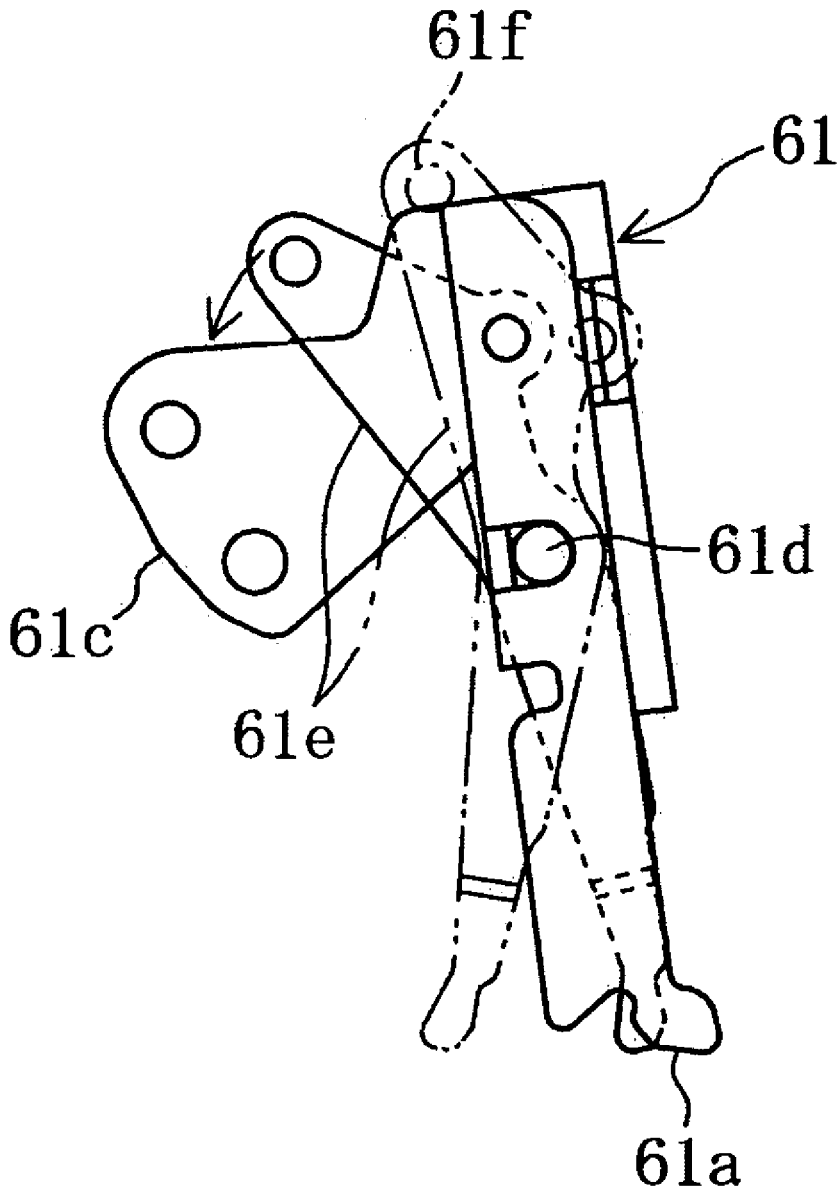
FIG. 10 is a side view of a second threading apparatus.

The second transferring member 61 has a laterally paired thread retainers 61*a* and 61*b* capable of retaining the needle thread 10 in the thread preparation path. The thread retainer 61*a* and 61*b* are bifurcated so that they can hold the needle thread 10. However, as indicated in FIG. 10, the left-hand thread retainer 61*a* is configured to sandwich the needle thread 10 in co-operation with the vertically directed plate member, which is rotatably pivoted by the pivot pin 61*d*. That is, the thread sandwich piece 61*e* is energized counter-clock wise as in FIG. 10 by the energizing spring not shown and the thread retainer 61*a* retains the needle thread 10 in co-operation with the thread sandwich piece 61*e* energized by the energizing spring. However, when the second thread transferring member 61 is elevated to the stand-by position, the engagement pin 61*f* fixed on the upper end of the thread sandwich piece 61*e* contacts a cam (not shown) fixed on the upper end of the second guide frame 62 from below, and the thread sandwich piece 61*e* rotates to the thread release position shown in double dotted chain line to release the thread retention of needle thread 10.

When the second thread transferring member 61 is lowered from the stand-by position to the thread turnover position, it retains the needle thread 10 hooked on the thread preparation path 30 with the thread retainer 61*b* on the right-hand side and the thread retainer 61*a* on the left side to carry it downward in a sandwiched state. Then when the second thread transferring member 61 is carried to the thread turnover position, the needle thread 10 retained in between the thread retainer 61*a* and 61*b* of the second thread transferring member 61 is positioned immediately in front of the eye 19*a* of the sewing needle 19 and stand-bys laterally directed in a tensed stated.

The second drive mechanism 65 is provided with a drive gear 66, double gears 67A, 67B and a rack forming member 68 and the gear 66, 67A, 67B, rack forming member 68 and the second stepping motor 69 are arranged on the left-hand side of the second guide frame 62. The second stepping motor 69 is fixed on the sewing machine frame and the drive gear 66 is connected to its output axis. The double gear 67A, 67B respectively are rotatably supported by the sewing machine frame and the output gear 66 fits with the large-diameter gear of the double gear 67A and the small-diameter gear of the double gear 67A fits with the large-diameter gear of the double gear 67B. The rack forming member 68 is vertically moveably guided against the second guide frame 62, 63 and the small-diameter pinion of the double gear 67B is fitted to the rack 68*a*.

When the second stepping motor 69 actuated, its drive power is transmitted to rack forming member 68 via the drive gear 66, double gear 67A, 67B and rack 68*a*, and the rack forming member 68 is vertically driven. When the rack forming member 68 is vertically moved, the moveable frame 64 connected to the rack forming member 68 by plurality of pulleys and wires (not shown) is driven approximately 2 times as fast as the rack forming member 68 while the second thread transferring member 61 connected to the moveable frame 64 via plurality of pulleys and wires (not shown) is driven approximately 2 times as fast as the moveable frame 64 (that is, approximately 4 times as fast as the rack forming member 68).

Next, the third thread transferring mechanism 70 which captures the needle thread 10 extending from the thread take-up lever 13 to the thread retainer 61*b* on the right-hand side of the second thread transferring member 61 with a thread hooking hook 76 and hooks the needle bar thread guide 18 on the lower end of the needle bar 11 is described. As shown in FIGS. 9, 12A, 13A, 14A and 14B, the horizontal L-shaped support plate 71 extending in the lateral direction is fixed on the rear end of the lower end of the second guide frames 62 and 63. On the left end of this L-shaped support plate 71, the upper end of the first link 72 which is bent to form a crank (when viewed from the side) is pivotally supported by the first pivotal pin 73. On the lower end of the first link 72, the left end of the second link 74 is pivotally supported by the second pivotal pin 75. On the right end of this second link 74, the central portion in the upright direction of the thread hooking hook 76 having a curved sickle-like hook 76A is pivotally supported by the third pivot pin 77. Furthermore, the base end part of the thread hooking hook 76 is pivotally supported by the forth pivotal pin 79 onto the pivot member 78 fixed on the bottom surface of the L-shaped support plate 71.

Figure 14A:
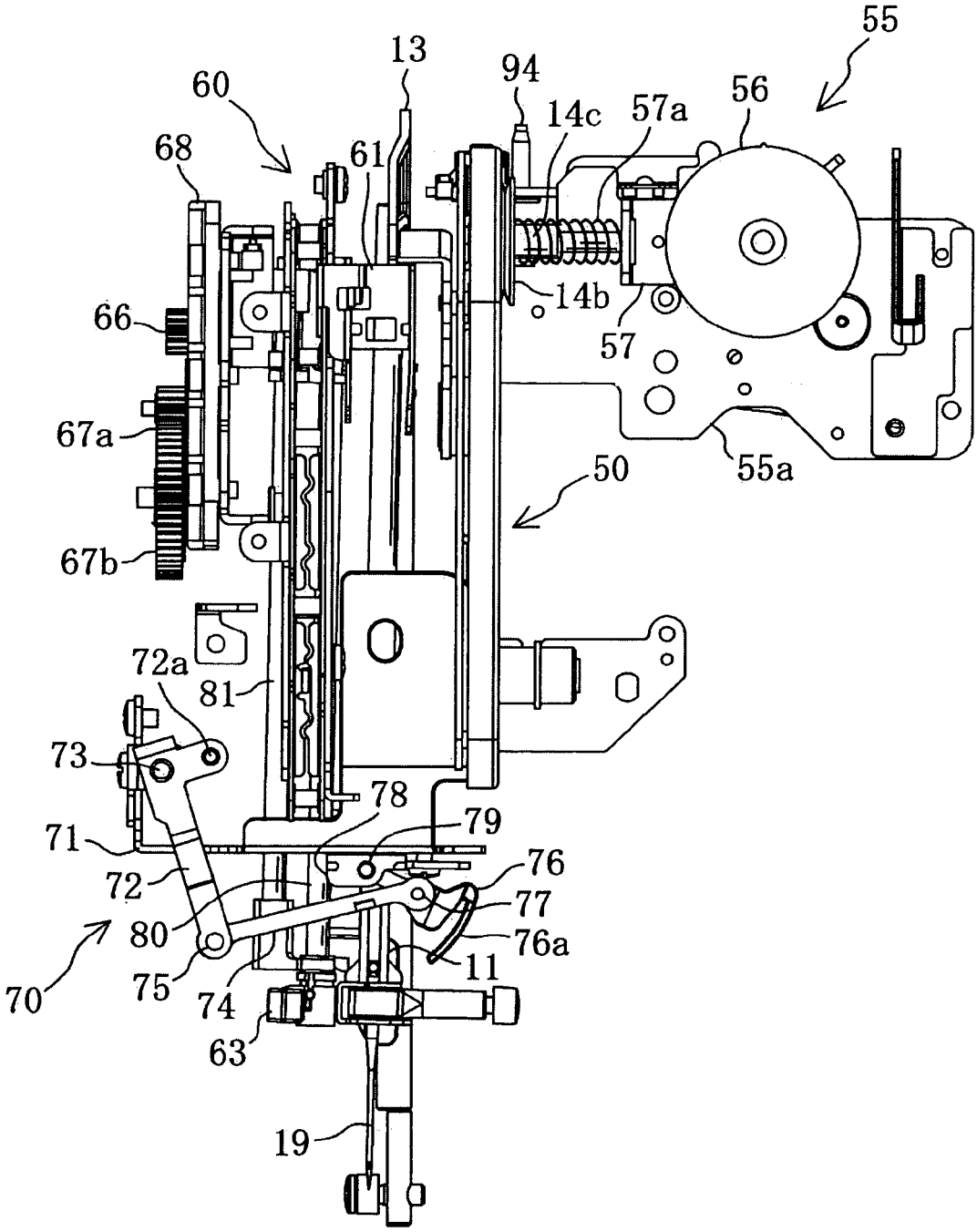
FIG. 14A is a front view of the automatic threading apparatus and the automatic needle threading mechanism (stand-by)
Figure 14B:
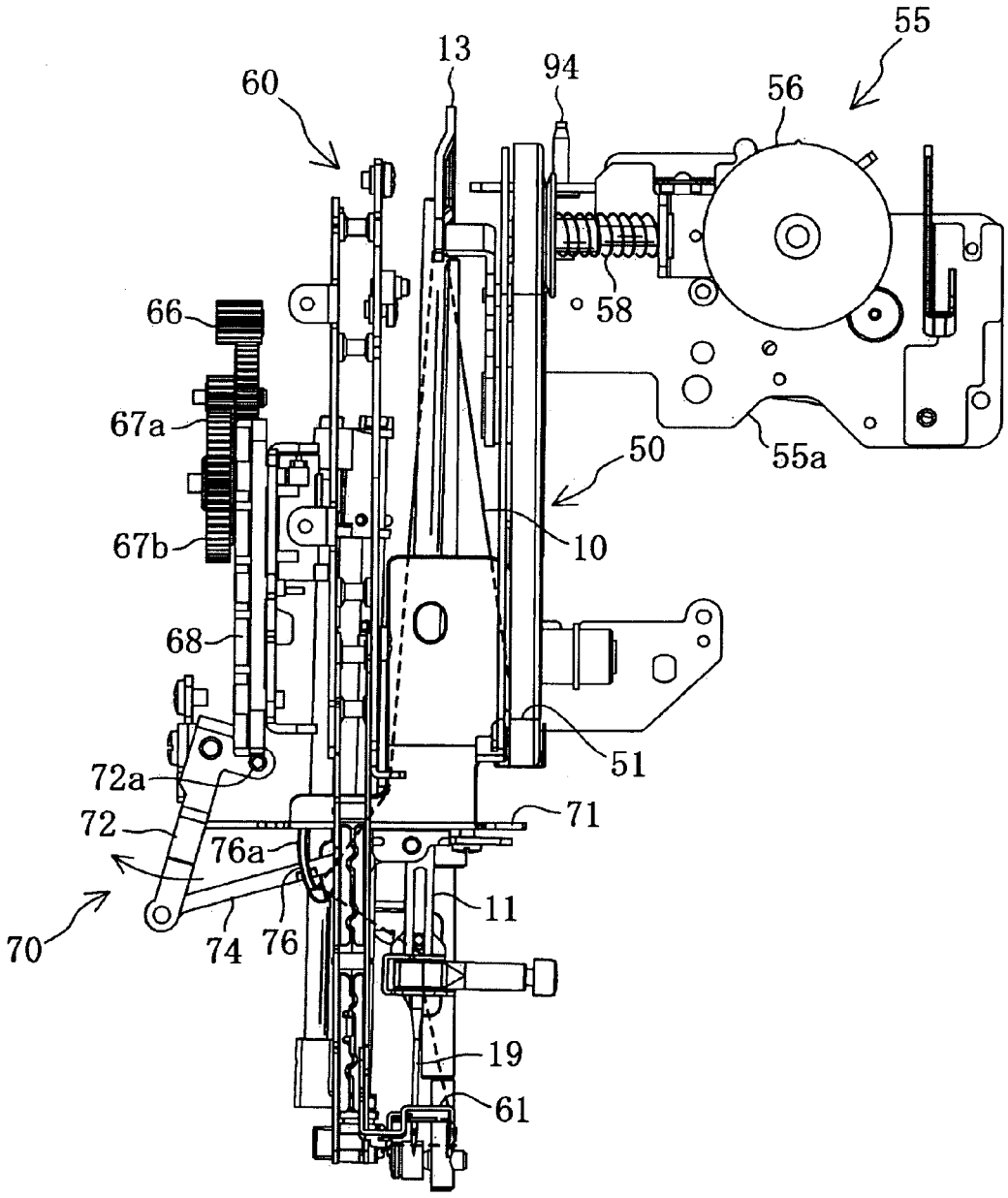
FIG. 14B is a front view of the automatic threading apparatus and the automatic needle threading mechanism (thread passed through the needle bar)

Because the first link 72 is energized in a counter-clockwise direction (when viewed from the front) by the pulling spring not shown, the thread hooking hook 76 as shown in FIG. 14A is always retracted to the right side of the needle bar 11. As opposed to this, immediately before the second thread transferring member 61 reaches the thread turnover position, as shown in FIG. 14B, because the lower end of the descending rack forming member 68 contacts the actuating pin 72*a* provided on the upper end of the first link 72 from above and compresses it downward for a predetermined distance, the first link 72 rotates in a clock wise direction. Because of this, the thread hooking hook 76 swings in front of the needle bar 11 in a circular-arc parallel to the vertical surface with the forth pivotal pin 79 as its rotational center. The thread hooking hook 76 as shown in FIG. 14B can be switched to the thread hooking position.

When the thread hooking hook 76 moves from right to left immediately in front of the needle bar 11, as will be described hereinafter, the thread adjusting disk 14*a*, 14*b* of the thread tension regulator 14 is switched to a closed state and the extent of the needle thread 10 from thread take-up lever 13 to the thread retainer 61*b* is appropriately tensed. Moreover, because in the vicinity of the needle bar thread guide 18, the needle thread is carried inclining towards needle bar thread guide 18, the needle thread 10 in the vicinity of the needle bar thread guide 18 is reliably caught by the hook 76*a* of the thread hooking hook 76 which swings in the vertical surface. While the thread hooking hook 76 passes the front of the needle bar 11 catching the needle thread 10 and switches to the thread hook state, the needle thread 10 caught by the thread hooking hook 76 is hooked onto the needle bar thread guide 18.

Next, a brief description is given hereinafter on the automatic needle threading mechanism 17. As shown in FIGS. 8, 9, 11A to 11F, 12A to 12F and 13A to 13F, the automatic needle threading mechanism 17 comprises a threading axis 80 arranged vertically reciprocably in the vertical direction in the immediate left of the needle bar 11, a threading guide axis 81 arranged in the vertical direction immediately to the left of the threading axis 80 and integrally reciprocable with the threading axis 80, a threading slider 82 reciprocably outer-fitted on to the upper end of the threading axis 80 and the threading guide axis 81, a hook mechanism having a threading hook (not shown) arranged in the lower end of the threading axis 80 and the rotational mechanism (not shown) to rotate the threading axis 80 90 degrees to pass the threading hook through the eye 19*a* of the sewing needle 19 at its lowest limit position. However, the threading slider 82 is reciprocably driven in synchronization with the rack forming member 68.

Because of this, the automatic needle threading mechanism 17 is lowered in synchronization with the second thread transferring mechanism 60 of the automatic threading device 16 and immediately before the second thread transferring member 61 moves to the thread turnover position, the threading axis 80 reaches the lowest position. Then, when the threading hook of the hook mechanism rotates approximately 90 degrees to the advancing direction and passes through the eye 19*a* of the sewing needle 19, the needle thread 10 retained by the second thread transferring member 61 is hooked by the threading hook.

After that, the threading hook of the hook mechanism rotates approximately 90 degrees in the retreating direction and passes through the eye 19*a* of the needle 19. At this time, the needle thread 10 is passed through the eye 19*a*, then, the threading axis 80 is elevated to return to its original position. The timing, in which the threading hook rotates in the retreating direction and passes through the eye 19*a* of the sewing needle 19 is referred to as the second timing and as described hereinafter, the thread adjusting disks 14A and 14*b* of the thread tension regulator 14 is switched to the closed state to release the tension imposed on the needle thread 10 in the extent from the thread take-up lever 13 to the thread retainer 61*a*. This enables the threading hook to uninterruptedly rotate back to the original position and complete the needle threading. For more information on such operation of the threading hook and sewing needle 19, refer to FIG. 16 of JP-A-2004-41355.

Next, the thread preparation path 30 is described. As described above, the thread preparation path 30 is a path to prepare the plurality of thread hooking sections (thread tension regulator 14, take-up spring 15, thread take-up lever 13, needle bar thread guide 18 etc.) so that they can be hooked by with the needle thread 10 extending from the thread spool 9 by the automatic threading device 16. The thread passing the needle thread hooking onto the thread preparation path 30 is manually performed in advance by the user by sequentially introducing the needle thread 10 from the thread introductory groove 31 formed on the sewing machine cover 35.

As shown in FIGS. 8, 11A and 12A, the lower right end portion of the front introduction cover 35*b* is a cavity 36 caving into the left side and the thread hook member 90 and 91 facing outward from this cavity 36 is formed. Inside the sewing machine cover 35, in between the first guide frame 52 and threading member 91, a plate-shaped pretensioner 93 capable of pressing the needle thread 10 against a receptor plate 92 with suitable pressure is provided and in the left side of the pretensioner 93, a vertically directed axial threading member 94 is provided to the right of the in a protruding manner. The threading member 95 is provided immediately below the thread retainer 61*b* on the right side of the second thread transferring member 61 in the stand-by position and the right side of the track of the second thread transferring member 61.

The threading member 95(refer to FIG. 12A) which is not shown in detail is a member to temporarily lock the needle thread 10 to a prescribed position because the transfer of the second thread transferring member 61 is started and the two thread retainers 61*a*, 61*b* need to be threaded. Also, a threading member 96(*refer* to FIG. 4) is provided to face the vertical groove of the L-shaped introductory groove 34*d* in between the thread guide cover 35*d* and screen plate 35*f*.

The needle thread 10 passed through the thread preparation path 30 will be processed as follows. The needle thread 10 extends to the left from the thread spool 9 and hooks onto the threading member 90 from above and hooks onto the thread hook 91A in the lower portion of the threading member 91 from below. The needle thread 10 then extends upward to hook onto the upper-protruding thread hook 91*b* of the threading member 91 from the front side and passes its right and rear side to further extend to the left side.

The needle thread 10 extending to the left from the upward protruding thread hook 91*b* passes between the receptor plate 92 and pretensioner 93, hooks onto the axial thread hook 94 from the rear side, and then hooks on to the introductory guide 43 of the thread take-up lever 13 in thread hook position from the rear side. The needle thread 10 in between the axial thread hook 94 and the introductory guide 43 is in a position to reliably hook onto the first thread transferring member 51 which moves along the outer perimeter of the first guide frame 52 from the stand-by position to the thread turnover position.

The needle thread 10 hooked onto the introductory guide 43 of the thread take-up lever 13 extends forward and downward to hook onto the thread hook member 95. Then the needle thread 10 hooks onto the lower thread hook 96*a* of the thread hook member 96 and extends upward. After having been hooked, the needle thread 10 is retained by the needle thread retainer 96*b* of the thread hook member 96. Then the downstream end of the needle thread 10 is trimmed by the trimmer 97 mounted on the thread hook member 96.

In case the thread is passed through the thread passing sections in this way, the needle thread 10 in between the thread hook members 95 and 96 laterally crosses the path and when the pair of thread retainers 61*a* and 61*b* of the second thread transferring member 61 move from the stand-by position to the thread turnover position, the needle thread 10 is reliably hooked onto the pair of the thread retainers 61*a* and 61*b* and transferred.

Figure 16:
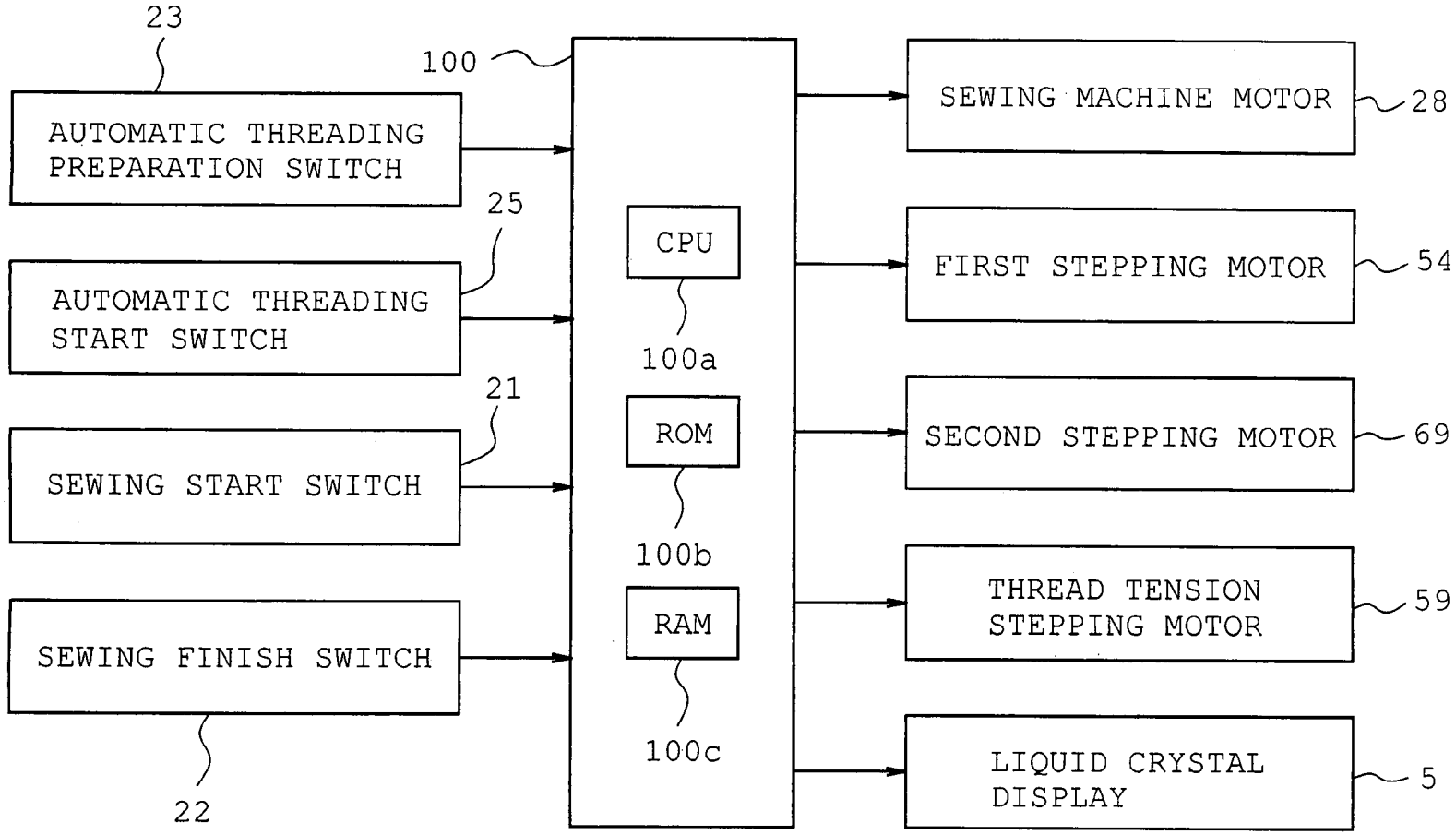
FIG. 16 is a block diagram of the control unit.

Next, a brief explanation of the control units of the sewing machine M is given. As indicated in FIG. 16, the microcomputer 100 configuring the control has a CPU 100*a*, ROM 100*b* and RAM 100*c* etc. This microcomputer 100 inputs input signals from the automatic thread hook preparation switch 23, automatic thread hook start switch 25, sewing start switch 2 and sewing finish switch 22 etc. to drive and control the sewing machine motor 28, the first stepping motor 54, second stepping motor 69, the thread tension stepping motor 59 and liquid crystal display 5 etc.

In the ROM 100B in this case, sewing data for various utility embroidery, a drive control program to drive control each motor 28, 54, 59 and 69 of the sewing machine M and a display control program to display control the liquid crystal display 5 is stored. Further, in the ROM 100*b*, as described earlier, on performing the thread hook by the automatic threading device 16, the drive pulse count to drive the thread tension stepping motor 59 is correlated to the drive pulse count (corresponds to an amount of drive) of the second stepping motor 69 and stored as the drive amount table. That is, in the drive amount table, as indicated in FIG. 17, the drive pulse counts "P0" and "NP 0" are correlated, wherein "P0" is the drive pulse count of the second stepping motor 69 at the time of starting the thread hook which is induced by the operation of the automatic thread hook preparation switch 23 and "NP 0" is the zero drive pulse of the thread tension stepping motor 59 to make the tension operated on the needle thread 10 "approximately zero" induced by switching the thread tension regulator 14 to an opened state. Also, the drive pulse count "P1" of the second stepping motor 69, when the first thread transferring member 51 moves to the thread turnover position and stops and drive pulse count "NP1" of the thread tension stepping motor 59 to switch the thread tension regulator 14 to a closed state and operate suitable tension "approximately 10 gf" to the needle thread 10 are correlated. Moreover, drive pulse count "P2" of the second stepping motor 69 when the threading hook of the automatic needle threading mechanism 17 starts the rotation to the retreating direction and passes out of the eye 19*a* of the sewing needle 19 and the zero drive pulse "NP 0" of the thread tension stepping motor 59 to make the tension of the needle thread 10 "approximately zero" by switching the thread tension regulator 14 to the open state are correlated.

When the thread tension regulator 14 is switched to a closed state, in case the tension operated on the needle thread 10 is set to approximately 10 gf, it is a suitable tension for enabling the second thread transferring member 61 to carry the needle thread 10 to the automatic needle threading mechanism 17. In this case, by transferring the thread end of the needle thread 10 towards the automatic needle threading mechanism 17 by the second thread transferring member 61 it is a suitable tension to enable the needle thread 10 guided to the vicinity of the thread introduction 15*c* to be moved to the thread hook 15*b*. Further, in this case, it is a suitable tension to enable the needle thread 10 to be hooked on the needle bar thread guide 18 by the thread hooking hook 76 of the third thread transferring mechanism 70.

Next, the operation and effect of the sewing machine M having the above configuration is described with reference to FIG. 18. In case the needle thread 10 is broken while sewing with the sewing machine M or in case the thread spool 9 is replaced, the needle thread passing operation is performed by the automatic threader 16. On performing the automatic thread hook, the automatic thread take-up lever 13 not positioned in the thread hook position is automatically shifted to the thread hook position and halted by operating the automatic thread hook preparation switch 23. When the automatic thread hook preparation switch 23 is operated, as described earlier, based on the drive amount table, thread tension stepping motor 59 is driven only to the extent of zero drive pulse and is switched to the state in which the tension imposed by the thread tension regulator 14 is "approximately zero", that is, the thread tension regulator 14 is in an opened state.

Next, the needle thread 10 extending from the thread spool 9 is inserted in sequence into the introductory groove 34*a*, introductory groove 34*b*, introductory groove 34*c*, and introductory groove 34*d* along the thread introductory groove 31 formed on the sewing machine cover 35. Finally, the needle thread 10 is turned in the retreating direction as to cross over the thread hook member 96 facing the vertical groove portion of the introductory groove 34*d* and hooked on the upper retainer 96 of the thread hook member 96 for tentative retention to have its lower stream trimmed by the trimmer 97.

By preparing for the thread hook in the above manner, because the needle thread 10 inserted into the thread introductory groove 31 has been hooked in advance on the predetermined thread preparation path 30, it can readily be automatically hooked onto the plurality of thread hooking sections including thread take-up lever 13 and thread tension regulator 14. That is, as indicated in FIGS. 11A, 12A and 13A, the needle thread 10 set in the thread preparation path 30 is in a state in which it is laterally crossed over the track of the first thread transferring member 51, hooked from behind onto the introductory guide 43 of the thread take-up lever 13 in thread hook position, and laterally crossed over the path of the pair of thread retainer 61*a* and 61*b* of the second thread transferring member. When the automatic thread hook start switch 25 is operated in such state, automatic thread hook is started. First the second stepping motor 69 is actuated and the thread transfer by the second thread transferring member 61 and the descending movement of the threading axis 80 is started simultaneously. However, because the actuation of the first stepping motor 54 is slightly delayed, the start of the thread transfer is slightly delayed. As shown in FIGS. 5 to 7, when the thread transfer by descending movement of the second thread transferring member 61 is started, the second thread transferring member 61 is retained by the pair of thread retainer 61*a* and 61*b* by hooking the needle thread 11 in between the thread hooks 95 and 96 from above. At this time, because the thread transfer by the first thread transferring member 51 is not executed, with the needle thread 10 stabilized in the thread preparation path 30, the thread sandwich piece 61*e* is rotated counter-clockwise by the spring elasticity of the energized spring caused by the descent of the second thread transferring member 61 and the needle thread 10 is reliably retained by the thread retainer 61*a* by the co-operation of the thread retainer 61*a* and the thread sandwich piece 61*e*.

Figure 11B:
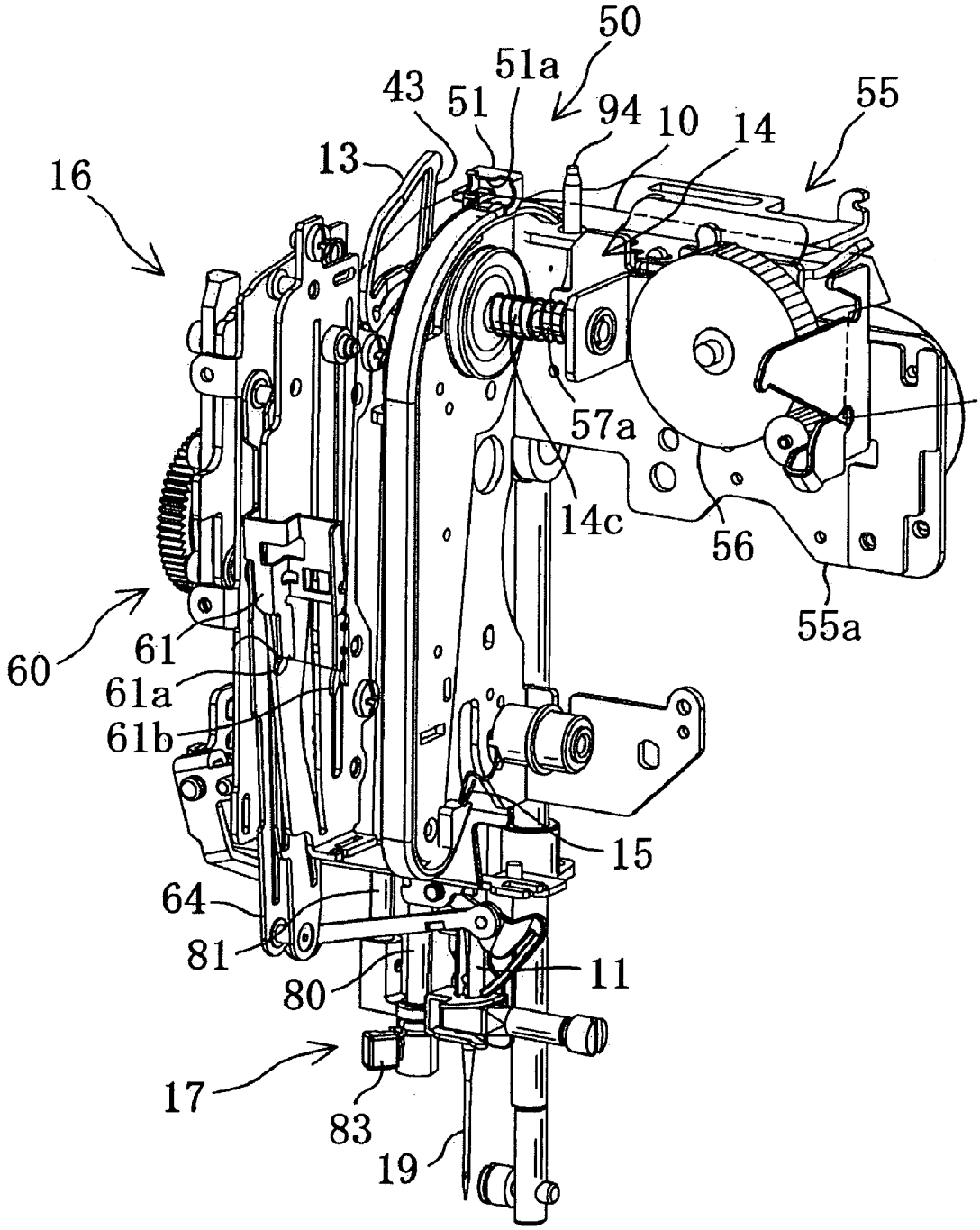
FIG. 11B is a perspective view of the automatic threading apparatus and automatic needle threading mechanism (thread hooked)
Figure 11C:
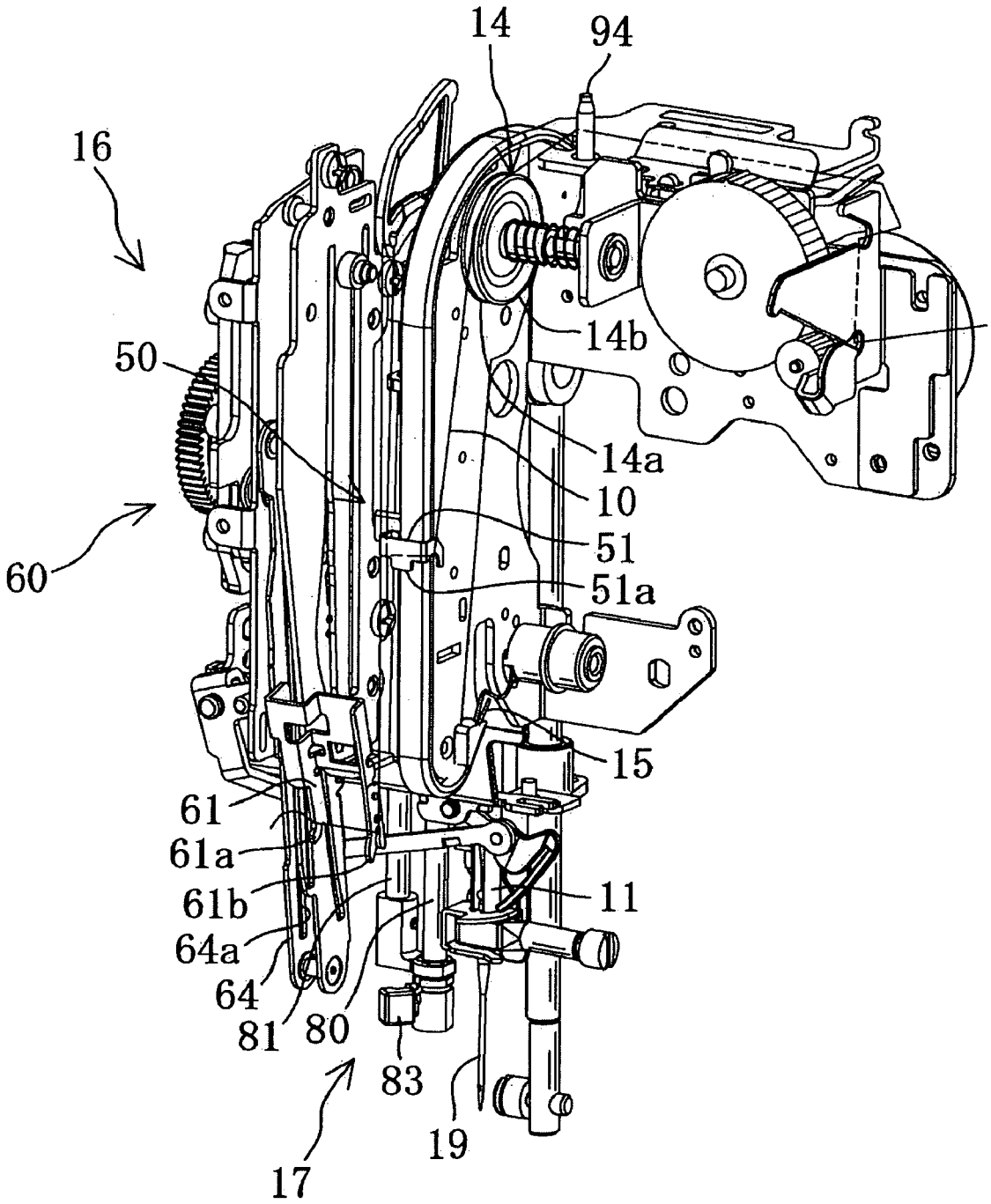
FIG. 11C is a perspective view of the automatic threading apparatus and automatic needle threading mechanism (thread passed through a thread take-up lever.
Figure 13B:
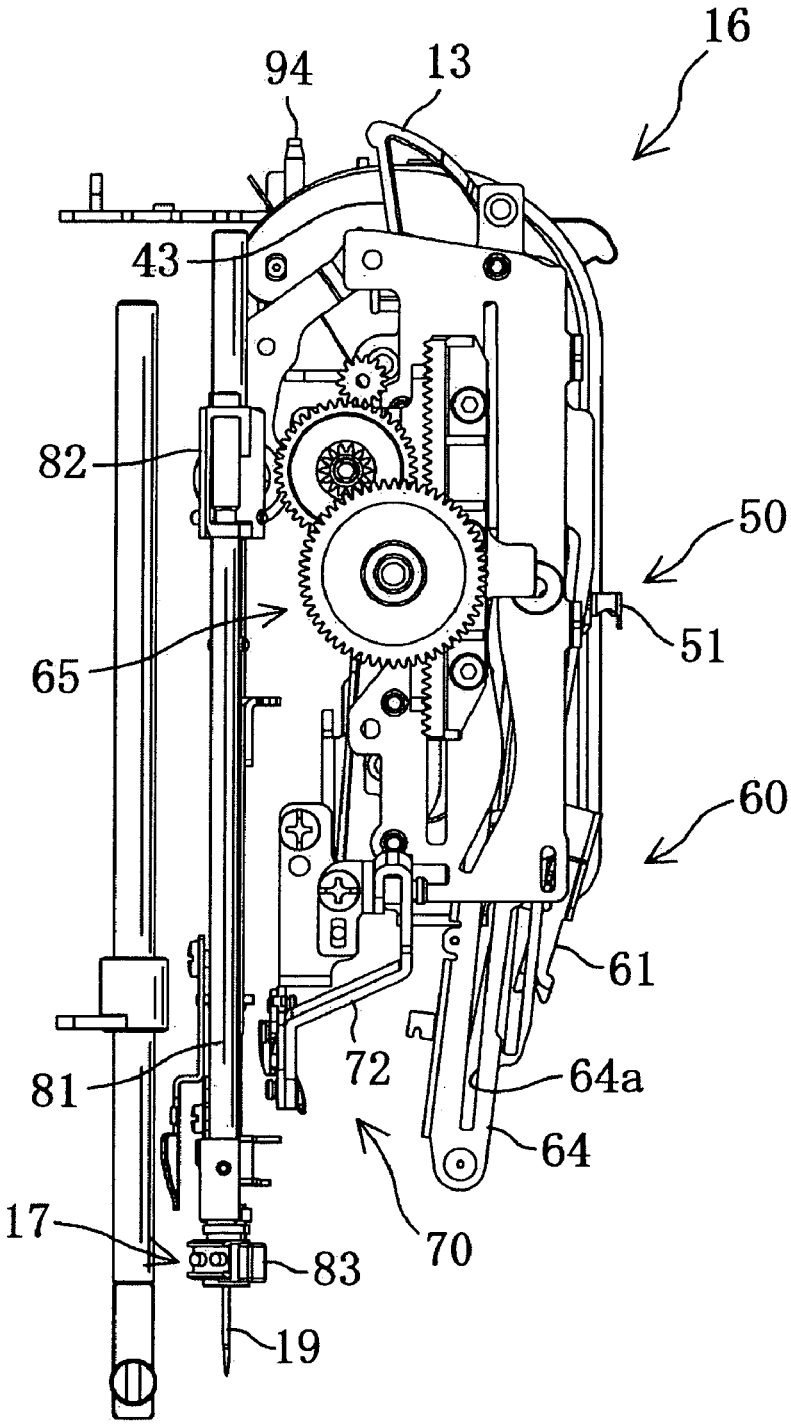
FIG. 13B is a side view of the automatic threading apparatus and automatic needle threading mechanism (thread passed)
Figure 13C:
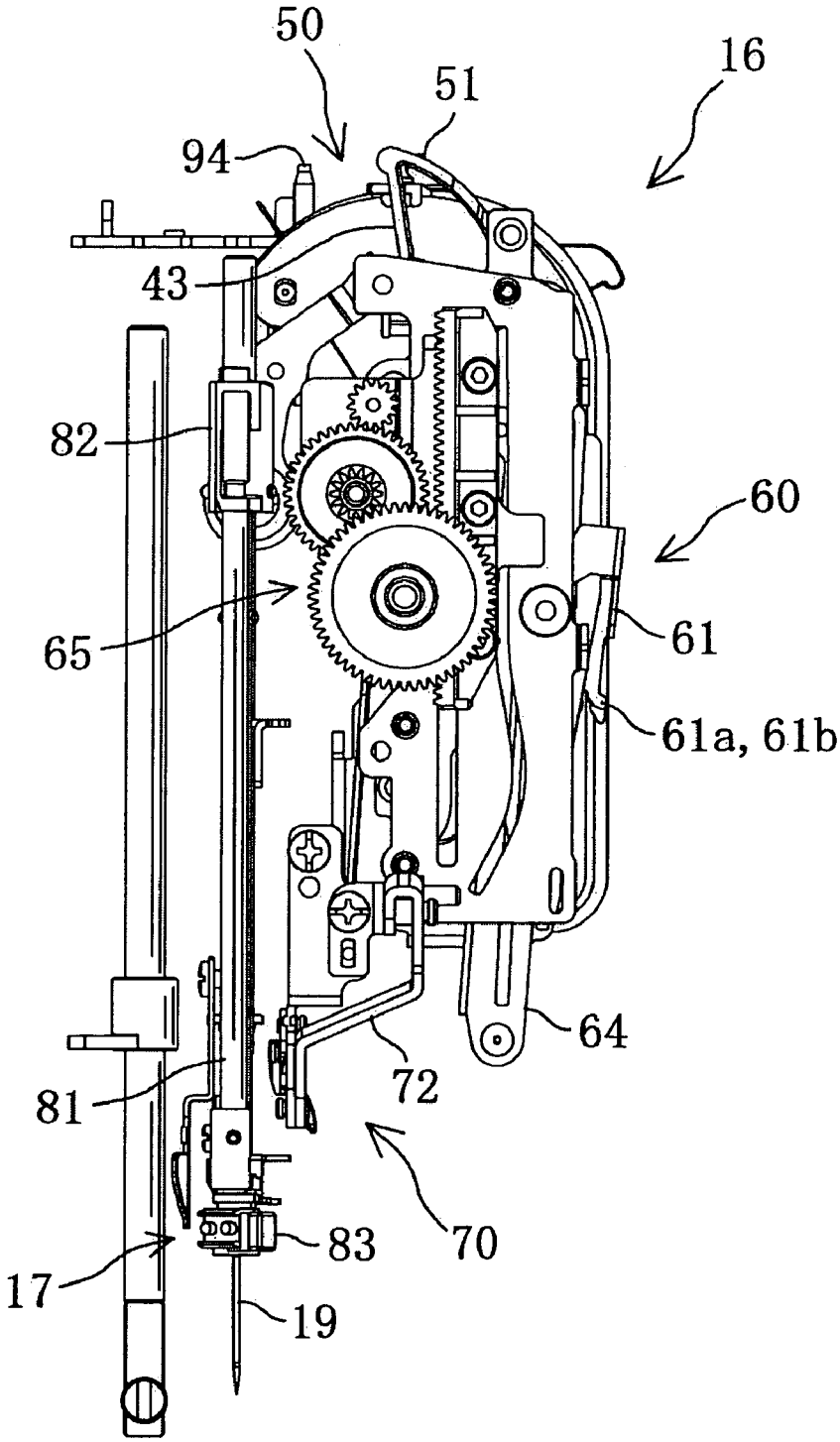
FIG. 13C is a side view of the automatic threading apparatus and the automatic needle threading mechanism (thread passed through the thread take-up lever)

After that as indicated in FIGS. 11B, 12B and 13*b*, the needle thread 10 in between the axial thread hook 94 and the introductory guide 43 of the thread take-up lever 13 is hooked by the thread hooking portion 51 and carried downward by the first thread transferring member 51. Then the first thread transferring member 51 moves downward hooking the needle thread 10 while the second thread transferring member 51 moves downward retaining the needle thread 10. As shown in FIGS. 11C, 12C and 13C, because of the downward transfer of the first and second thread transferring member 51 and 61, the needle thread 10 fed from the thread spool 9 after going through the thread tension regulator 14 is drawn by being pulled toward the first and second thread transferring member 51 and 61.

Figure 11D:
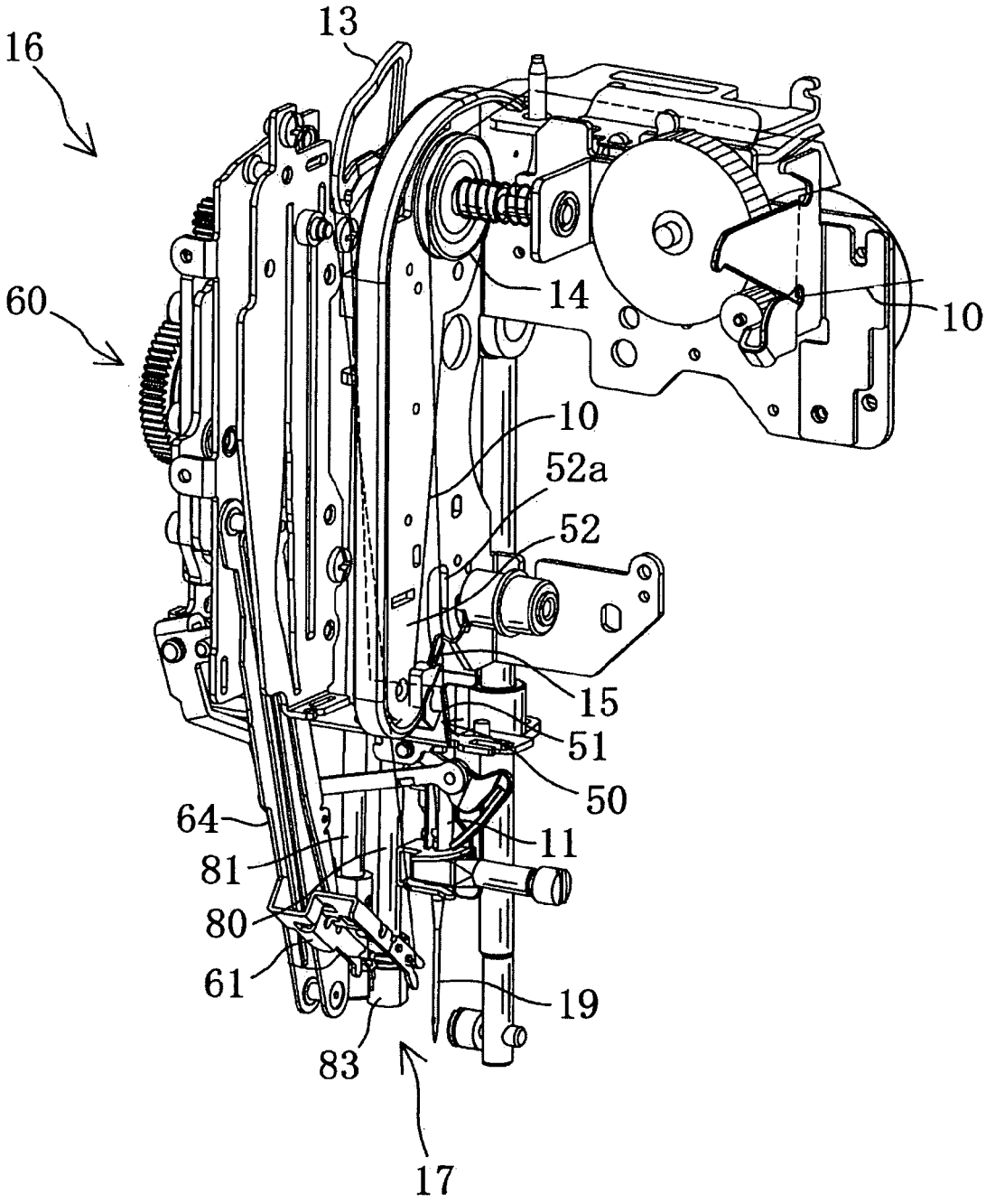
FIG. 11D is a perspective view of the automatic threading apparatus and automatic needle threading mechanism (thread passed through a take-up spring)
Figure 13D:
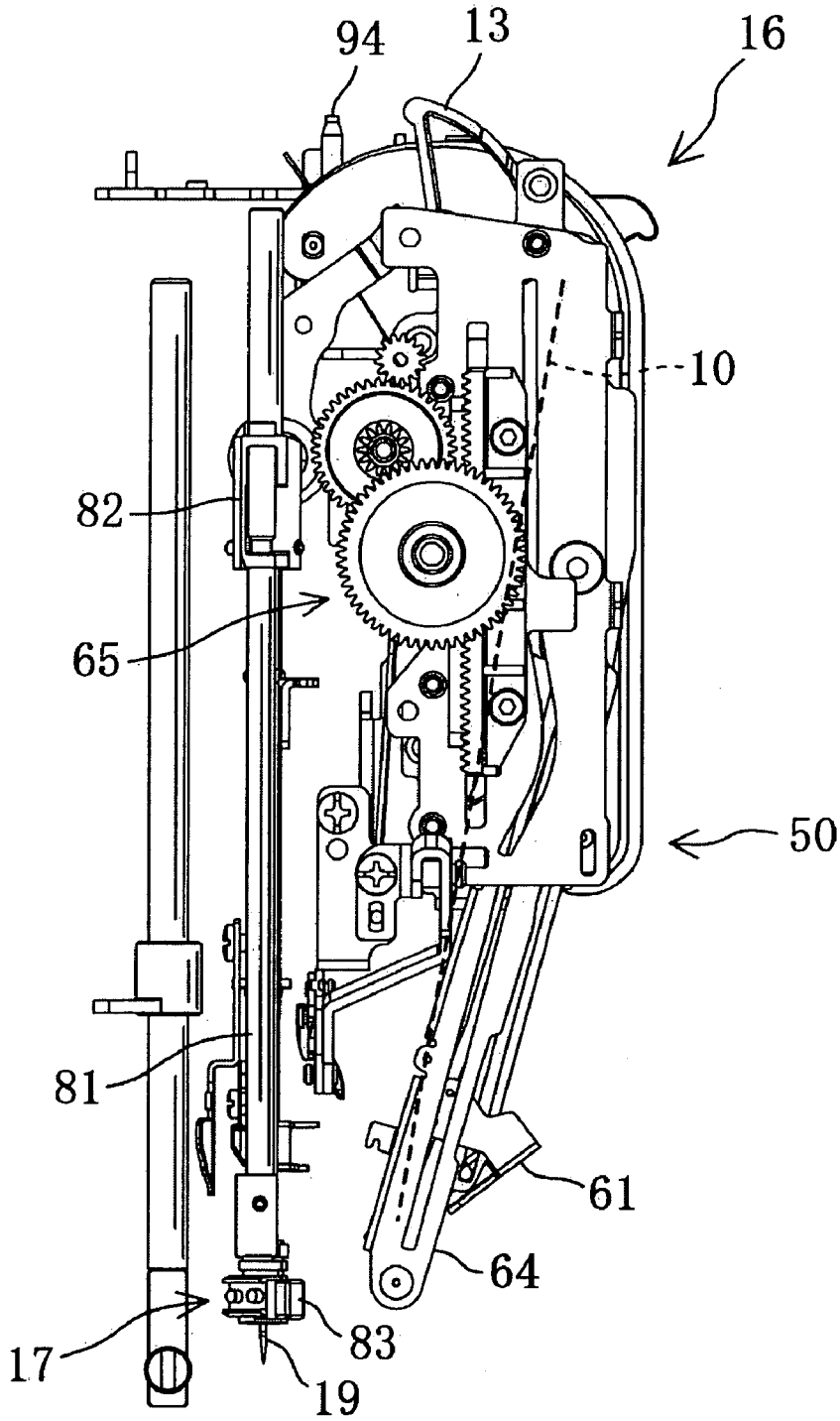
FIG. 13D is a side view of the automatic threading apparatus and the automatic needle threading mechanism (thread passed through the take-up spring)
Figure 13E:
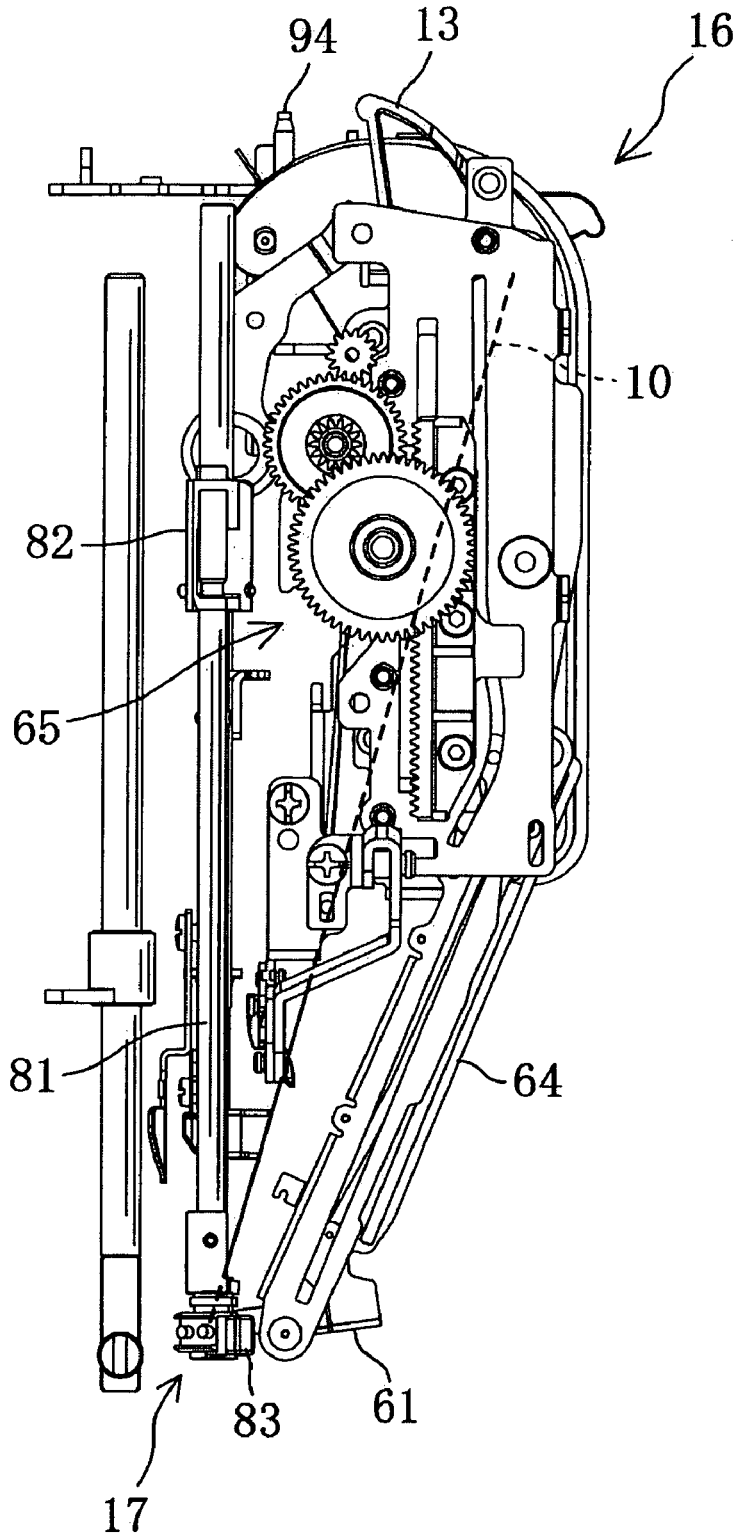
FIG. 13E is a side view of the automatic threading apparatus and the automatic needle threading mechanism (thread turnover)
Figure 13F:
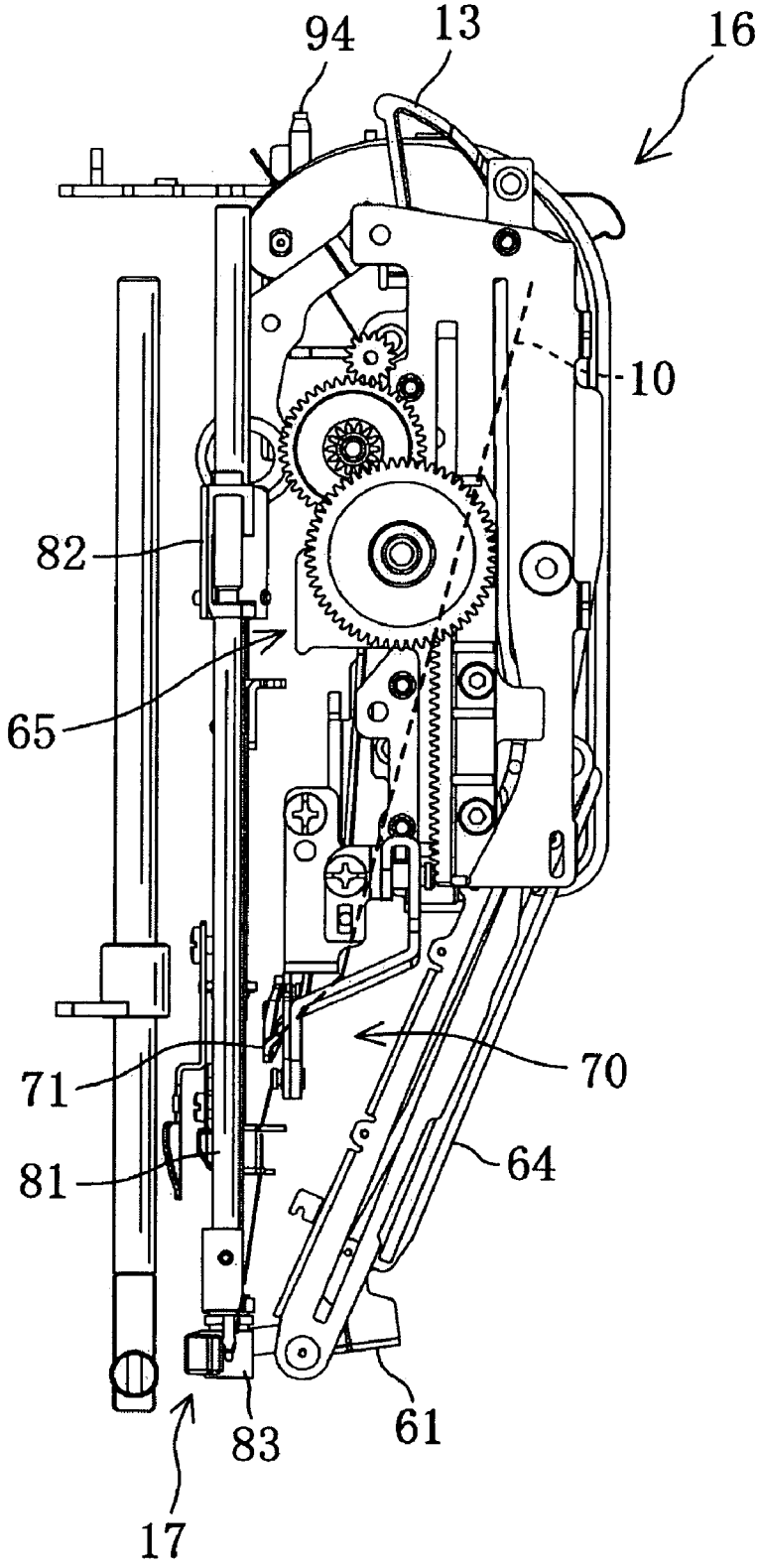
FIG. 13F is a side view of the automatic threading apparatus and the automatic needle threading mechanism (thread passed through the needle bar)

Because of this, among the needle thread 10 in between the second thread transferring member 51 and 61, the needle thread 10 hooked from the rear of the introductory guide 43 of the thread take-up lever 13 is guided to the thread take-up lever thread introduction 42 by the introductory guide 43 which in turn is introduced to the thread take-up lever thread hook 41 by the thread take-up lever thread introduction 42 and hooked. At the same time, the needle thread 10 extending from axial thread hook member 94 to the first thread transferring member 51 is hooked in between the thread adjusting disks 14*a* and 14*b* of the opened state thread tension regulator 13. Furthermore, as shown in FIGS. 11D, 12D and 13D, the first thread transferring member 51 reaches the thread turnover position and thread transfer is halted, as shown in FIG. 15A, needle thread 10 which was hooked on the thread hooking portion 51A is moved immediately below the thread introduction 15*c* of the take-up spring 15. At this point, the second thread transferring member 61 is in the position before reaching the thread turnover position.

At this point, that is, in the first timing, because the drive pulse count of the second stepping motor 69 has reached P1, based on the drive amount table, thread tension stepping motor 59 is driven only to the extent of the drive pulse count "NP1". The tension imposed by thread tension regulator 14 is set to "approximately 10 gf" and the thread tension regulator 14 is switched to the closed state. Therefore, since the thread transfer by the second thread transferring member 61 is continued regardless of the predetermined thread amount of the needle thread 10 from the thread retainer 61*a* to the thread tension regulator 14, as described earlier, a suitable tension is incurred on needle thread 10 in the extent from the thread retainer 61*a* to the thread tension regulator 14.

As a result, as shown in FIGS. 11E, 12E, 13E and 15B, the needle thread 10 hooked on thread hooking portion 51 is introduced to the notch 52*a* then onto the thread introduction 15*c* and hooked on the thread hook 15*b*. When the second thread transferring member 61 the thread turnover position which is the lowest position, the thread transfer is halted. However, the second stepping motor 69 is still driven and at this point, the lower end of the descending rack forming member 68 presses down the activation pin 72*a* of the first pin 72 of the third thread transferring mechanism 70 from above the thread hook 76 passes the front of the needle bar 11 and switches to the thread hooking position as shown in FIGS. 11F, 12F, 13F and 14B.

Therefore, as described earlier, the needle thread 10 in the vicinity of the needle bar thread guide 18 is inclined towards the needle bar thread guide 18 and also suitably tensed thereby, reliably caught by the hook 76*a* of the thread hook 76 hook 76*a* swung in the vertical surface.

Because the thread hook 76 passes the front side of the needle bar 11 with the needle thread 10 captured and switched to the thread hook position, the needle thread 10 captured by the thread hook 76 is reliably hooked onto the needle bar thread guide 18.

When the needle thread 10 is hooked onto the needle bar thread guide 18 by the thread hook 76, that is, in the second timing, because the drive pulse count of the second stepping motor 69 has reached P2, based on the drive amount table, the thread tension stepping motor 59 is driven to the extend of zero drive pulse "NP0", and the tension imposed by the thread tension regulator 14 is switched to the open state in which the tension is "approximately zero".

Figure 18:
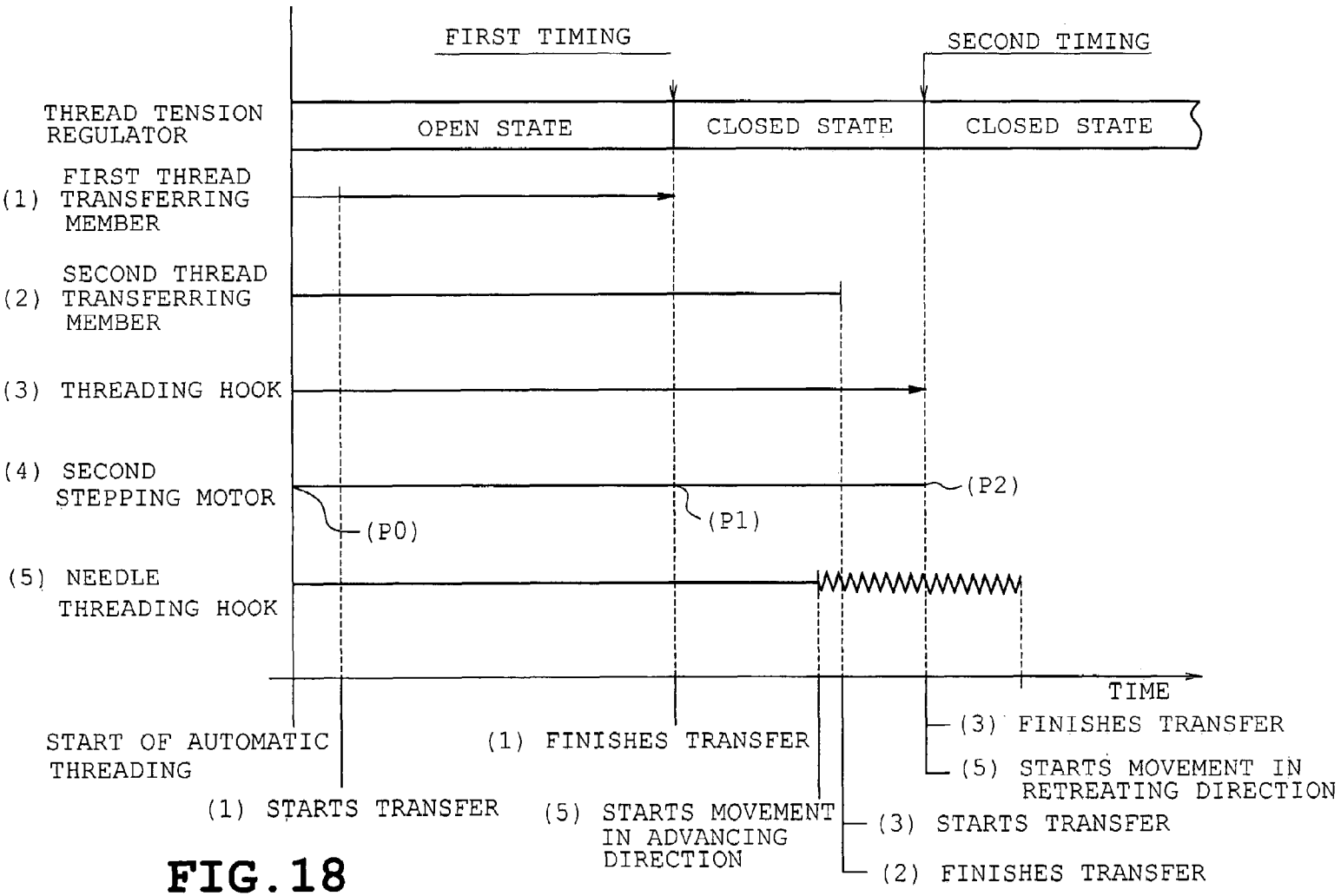
FIG. 18 is a timing chart of each member.

On the other hand, as shown in FIG. 18, in synchronization with the automatic threader 16, the threading guide axis 81 of the automatic needle threading mechanism 17 starts to descend. Immediately before the second thread transferring member 61 reaches the thread turnover position, the threading axis 80 reaches the lowest limit position, wherein the descending movement is halted and the thread hook is rotated to the advancing direction.

In the second timing in which the thread hook passes through the eye 19*a* of the sewing needle and needle thread 10 retained by the second thread transferring member 61 is hooked on the threading hook, thread tension regulator 14 is switched to the opened state as described earlier. Therefore, the tension of the needle thread 10 is released and the threading hook is able to return to the original position interruptedly, and needle threading is performed.

After that, the threading slider 82, threading axis 80 and threading guide axis 81 are respectively elevated to their original position. Also, the first and the second thread transferring members 51 and 61 respectively are returned to their original positions. Therefore, at this point, thread hooking for sewing is complete and sewing can be readily performed.

As described above, this in this sewing machine M, the needle thread 10 retained in the predetermined thread preparation path 30 is carried by the first and the second thread transferring mechanism 50 and 60, hooked subsequently onto the plurality of thread hooking sections (thread tension regulator 14, take-up spring 15, thread take-up lever 13 and needle bar thread guide 18 etc.) and finally turned over to the automatic needle threading mechanism 17.

Furthermore, in correlation with the transferred position of the second thread transferring mechanism 60, in the first timing, in which the first thread transferring member 51 has reached the thread turnover position, the thread tension regulator 14 can be switched to the opened state. Therefore, the needle thread 10 hooked on to the thread hooking portion 51A is hooked onto the take-up spring 15 while the needle thread 10 in the vicinity of the needle bar thread guide 18 is suitably tensed thereby, reliably capturing the needle thread 10 with the thread hooking hook 76 of the third thread transferring mechanism 70 and the captured needle thread 10 can be reliably hooked on the needle bar thread guide 18. Further the threading axis 80 of the automatic threading device 16 reaches the lowest limit position with the thread tension regulator 14 in the opened state and the threading hook is rotated in the advancing direction. Because of this, the thread hook passes through the eye 19*a* of the sewing needle and the needle thread 10 retained by the second thread transferring member 61 is suitably tensed therefore the needle thread 10 can be reliably hooked on the threading hook.

On the other hand, in the second timing in which the thread hook of the automatic threading device 16 passes through the eye 19*a* of the sewing needle and the tensed needle thread 10 retained by the second thread transferring member 61 is hooked, thread tension regulator 14 is switched to the opened state. Therefore, the tension of the needle thread 10 is released and the threading hook can uninterruptedly return to the original position with the needle thread 10 hooked to reliably perform the needle threading process. Such timely open/close switching of the thread tension regulator 14 increases the reliability of the hooking on the plurality of thread hooking sections.

Also, based on the drive pulse count of the second stepping motor 69 which moves the second thread transferring member 61 of the second thread transferring mechanism 60, that is, based on the drive amount of the second stepping motor 69 which is the standard on which the thread hooking operation is based with reference to the drive amount table, on the first and the second timing, the drive of the thread tension stepping motor 59 is controlled to switch the opened/closed status of the thread tension regulator 14. Because of this, the open/close movement of the thread tension regulator 14 can be performed accurately in synchronization with the hooking to a plurality of the thread hooking sections.

The present invention can be implemented by incorporating various changes for example, to the first and second thread transferring mechanism etc. to the extent that they do not deviate from the intensions of the present invention.

The present invention is applicable to domestic and also industrial sewing machine. Other forms of implementation incorporating various changes to the above embodiment are also possible and the current invention includes such forms incorporating the various changes.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A sewing machine comprising:

a needle bar supporting a sewing needle;

a thread take-up lever;

a needle thread supply;

a thread tension mechanism including a thread tension regulator and a thread tension adjusting unit adjusting tension applied by the thread tension regulator;

a plurality of thread hooking sections including the thread take-up lever and the thread tension regulator;

a needle threading mechanism to automatically pass the needle thread through a thread eye of the sewing needle;

a thread transferring mechanism automatically hooking onto the thread hooking sections the needle thread which extends from the thread supply and which is retained in a predetermined thread preparatory path while retaining the needle thread so that the needle thread can be turned over to the needle threading mechanism; and a control unit which controls the thread tension adjusting unit so that tension applied to the needle thread becomes a predetermined tension that correlates with a transfer position of the needle thread transferred by the thread transferring mechanism.

2. The sewing machine according to claim 1, wherein a plurality of the thread hooking sections further include a thread take-up spring and a needle bar thread guide.

3. The sewing machine according to claim 1, wherein the control unit controls the thread tension adjusting unit so that the thread tension regulator is switched to a closed state in a first timing during transfer of the needle thread by the thread transferring mechanism and so that the thread tension regulator is switched to an open state in a second timing immediately before threading by the threading tension regulator.

4. The sewing machine according to claim 2, wherein the thread transferring mechanism includes a first thread transferring unit which hooks the needle thread onto the thread tension regulator, the thread take-up spring and the thread take-up lever, a second thread transferring unit which transfers the needle thread near to the thread eye of the sewing needle while retaining a thread end of the needle thread and turns over the needle thread to the needle threading mechanism, and a third thread transferring unit which hooks the needle thread onto the needle bar thread guide in a period of time from start of needle thread transfer by the second thread transferring unit to completion of needle thread turnover to the needle threading mechanism.

5. The sewing machine according to claim 3, wherein the thread hooking sections further include a thread take-up spring and a needle bar thread guide, and the thread transferring mechanism includes a first thread transferring unit which hooks the needle thread onto the thread tension regulator, the thread take-up spring and the thread take-up lever, a second thread transferring unit which transfers the needle thread near to the thread eye of the sewing needle while retaining a thread end of the needle thread and turns over the needle thread to the threading mechanism, and a third thread transferring unit which hooks the needle thread onto the needle bar thread guide in a period of time from start of needle thread transfer by the second thread transferring unit to completion of needle thread turnover to the needle threading mechanism.

6. The sewing machine according to claim 5, wherein transfer of the needle thread by the first thread transferring unit is finished in the first timing.

7. The sewing machine according to claim 4, further comprising a first drive unit which drives the first thread transferring unit and a second drive unit which drives the second thread transferring unit, wherein the control unit controls the thread tension adjusting unit based on an amount of drive of the second drive unit.

8. The sewing machine according to claim 4, wherein the thread take-up spring includes a coil, a thread hook extending from the coil onto which the needle thread is hooked and a thread introduction which introduces the needle thread to the thread hook, wherein the needle thread is transferred near to the thread introduction of the thread take-up spring.

9. The sewing machine according to claim 5, wherein the thread take-up spring includes a coil, a thread hook extending from the coil onto which the needle thread is hooked and a thread introduction which introduces the needle thread to the thread hook, wherein the needle thread is transferred near to the thread introduction of the thread take-up spring.

10. The sewing machine according to claim 9, wherein thread tension applied by the thread tension regulator switched to the closed state in the first timing is predetermined so that the second transferring unit is capable of transferring the needle thread toward the needle threading mechanism against the thread tension.

11. The sewing machine according to claim 10, wherein the thread tension is further predetermined so that the needle thread is tensioned on the thread hooking sections so as to be movable when guided near to the thread introduction by transferring the thread end of the needle thread toward the needle threading mechanism by the second thread transferring unit.

12. The sewing machine according to claim 11, wherein the thread tension is further predetermined so that the needle thread is tensioned so as to be capable of being hooked on the needle bar thread guide by the third thread transferring unit.

* * * * *